US009746801B2

(12) United States Patent
Jang et al.

(10) Patent No.: US 9,746,801 B2
(45) Date of Patent: Aug. 29, 2017

(54) CARTRIDGES AND ELECTROPHOTOGRAPHIC IMAGE FORMING APPARATUS USING THE SAME

(71) Applicant: Samsung Electronics Co., Ltd., Suwon-si (KR)

(72) Inventors: Ho-jin Jang, Suwon-si (KR); Jin-hwa Hong, Suwon-si (KR); Seung-gweon Lee, Suwon-si (KR); Jong-in Kim, Suwon-si (KR); Sung-min Park, Gwacheon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/293,505

(22) Filed: Oct. 14, 2016

(65) Prior Publication Data

US 2017/0185002 A1 Jun. 29, 2017

(30) Foreign Application Priority Data

Dec. 23, 2015 (KR) ..... 10-2015-0185094

(51) Int. Cl.
*G03G 15/08* (2006.01)

(52) U.S. Cl.
CPC ..... *G03G 15/0889* (2013.01); *G03G 15/0862* (2013.01)

(58) Field of Classification Search
CPC ..... G03G 15/0889; G03G 15/0862
See application file for complete search history.

(56) References Cited

U.S. PATENT DOCUMENTS

| | | | | |
|---|---|---|---|---|
| 5,229,823 | A | 7/1993 | Kalyandurg et al. | |
| 5,287,151 | A | 2/1994 | Sugiyama | |
| 6,510,291 | B2 | 1/2003 | Campbell et al. | |
| 8,494,380 | B2 * | 7/2013 | Carot | G03G 15/0863 399/12 |
| 2005/0117920 | A1 | 6/2005 | Ogata et al. | |
| 2006/0216062 | A1 | 9/2006 | Kawai | |
| 2008/0025757 | A1 | 1/2008 | Sato et al. | |

(Continued)

FOREIGN PATENT DOCUMENTS

| | | |
|---|---|---|
| JP | 8-87165 | 4/1996 |
| JP | 9-80894 | 3/1997 |
| JP | 2010-32779 | 2/2010 |

OTHER PUBLICATIONS

International Search Report and Written Opinion of the International Searching Authority dated Jan. 25, 2017 in International Patent Application PCT/KR2016/011458.

(Continued)

*Primary Examiner* — G. M. Hyder
(74) *Attorney, Agent, or Firm* — Staas & Halsey LLP

(57) ABSTRACT

A cartridge attachable to and detachable from a body of an image forming apparatus includes a toner container containing a toner and including a stirring member configured to stir the toner, and a developing section connected to the toner container through a supply port and including a developing section stirring member configured to stir the toner, a supply roller configured to receive the toner supplied from the developing section stirring member, and a developing roller configured to receive the toner supplied from the supply roller. A rotation ratio of the stirring member to the supply roller is 5% to 25%.

17 Claims, 19 Drawing Sheets

(56) References Cited

U.S. PATENT DOCUMENTS

| | | | | |
|---|---|---|---|---|
| 2008/0293331 | A1 | 11/2008 | Chen et al. | |
| 2009/0257782 | A1* | 10/2009 | Ishikake | G03G 15/0856 399/254 |
| 2011/0293332 | A1 | 12/2011 | Kawakami | |
| 2014/0219690 | A1* | 8/2014 | Li | G03G 21/1647 399/279 |

OTHER PUBLICATIONS

Extended European Search Report dated Apr. 25, 2017 in European Patent Application No. 16204144.6.

* cited by examiner

CARTRIDGES AND ELECTROPHOTOGRAPHIC IMAGE FORMING APPARATUS USING THE SAME

CROSS-REFERENCE TO RELATED APPLICATIONS

This application claims the priority benefit of Korean Patent Application No. 10-2015-0185094, filed on Dec. 23, 2015, in the Korean Intellectual Property Office, the disclosure of which is incorporated herein in its entirety by reference.

BACKGROUND

1. Field

The following description relates to electrophotographic image forming apparatuses for forming images on recording media by using electrophotography, and cartridges mountable in the electrophotographic image forming apparatuses.

2. Description of the Related Art

An image forming apparatus using electrophotography forms a visible toner image on a photoconductor by supplying a toner to an electrostatic latent image formed on the photoconductor, transfers the toner image onto a recording medium, and then fixes the transferred toner image on the recording medium, thereby printing an image on the recording medium.

A process cartridge is an assembly of components for forming a visible toner image, and is a consumable to be replaced after the life thereof has ended. The process cartridge may have a variety of structures, e.g., a structure in which a photoconductor, a developing roller for supplying a toner to the photoconductor, and a toner container containing a toner are integrally provided, a structure divided into an imaging cartridge including a photoconductor and a developing roller, and a toner cartridge including a toner container, and a structure divided into a photoconductor cartridge including a photoconductor, a developing cartridge including a developing roller, and a toner cartridge including a toner container.

A toner contained in a toner container is supplied to a developing section in which a developing roller is provided. The toner container includes a stirring member for stirring the toner. The stirring member includes a stirring film. When the stirring member rotates, the stirring film contacts an internal wall of the toner container and then is elastically straightened after the contact is terminated, thereby stirring and supplying the toner to the developing section. If the stirring film is left for a long time in the state contacting the internal wall of the toner container, the stirring film may deform and thus stirring performance and supply performance thereof may deteriorate.

SUMMARY

Provided are cartridges and electrophotographic image forming apparatuses capable of stably stirring toners contained in toner containers and stably supplying the toners to developing sections.

Provided are cartridges and electrophotographic image forming apparatuses capable of preventing deterioration of properties of toners contained in toner containers.

Additional aspects will be set forth in part in the description which follows and, in part, will be apparent from the description, or may be learned by practice of the presented embodiments.

According to an aspect of an embodiment, a cartridge attachable to and detachable from a body of an image forming apparatus includes a toner container containing a toner and including a toner container stirring member configured to stir the toner in the toner container, a developing section connectable to the toner container to receive the toner from the toner container through a supply port and including a developing section stirring member configured to stir the received toner from the toner container, a supply roller configured to receive the toner supplied from the developing section stirring member, and a developing roller configured to receive the toner supplied from the supply roller, a first power transmission member coupled to a rotation shaft of the toner container stirring member, and a second power transmission member configured to engage with the first power transmission member to intermittently rotate the toner container stirring member based on a rotation of the supply roller, wherein a rotation ratio of the toner container stirring member to the supply roller is 5% to 25%.

A rotation ratio of the developing section stirring member to the supply roller may be 50% to 100%.

The toner container stirring member may include a stirring film extending from the rotation shaft of the toner container stirring member in a radius direction, and the cartridge may further include a reference location provider configured to provide a reference location in such a manner that the stirring film is separated from an internal wall of the toner container.

The cartridge may further include a housing configured to support the rotation shaft of the toner container stirring member, the reference location provider may include a first indicator provided on the first power transmission member, and a second indicator provided on a side wall of the housing, and the stirring film may be separated from the internal wall of the toner container, by aligning the first indicator with the second indicators.

The reference location provider may include a first indicator provided on the first power transmission member, and a second indicator provided on the second power transmission member, and the stirring film may be separated from the internal wall of the toner container, by aligning the first indicator with the second indicators.

The cartridge may further include a rotation location detector configured to detect a rotation location of the stirring film.

According to an aspect of an embodiment, an electrophotographic image forming apparatus includes a body, and the above-described cartridge.

A rotation ratio of the developing section stirring member to the supply roller may be 50% to 100%.

The toner container stirring member may include a stirring film extending from the rotation shaft of the toner container stirring member in a radius direction, and the body may include a motor configured to rotate the toner container stirring member, and a controller configured to control the motor to stop the stirring member at a location where the stirring film is separated from the toner container.

The toner container stirring member may have a plurality of stop locations, at least one of the plurality of stop locations may be the location where the stirring film is separated from the internal wall of the toner container, and the controller may control the motor to stop the toner container stirring member at the stop location corresponding to the location where the stirring film is separated from the internal wall of the toner container.

The electrophotographic image forming apparatus may further include a reference location provider configured to provide a reference location in such a manner that the stirring film is provided at the location where the stirring film is separated from the internal wall of the toner container. The controller may control the motor to stop the toner container stirring member at the reference location.

The electrophotographic image forming apparatus may further include a rotation location detector configured to detect the reference location of the toner container stirring member, and the controller may control the motor based on a detection signal of the rotation location detector.

According to an aspect of an embodiment, a cartridge attachable to and detachable from a body of an image forming apparatus includes a toner container containing a toner, a developing section connectable to the toner container to receive the toner from the toner container, a light guide member including a light exit surface and a light incident surface provided to face each other in at least one of the toner container and the developing section, an optical sensor including a light emitter configured to emit light toward the light exit surface, and a light receiver configured to receive the light incident on the light incident surface, a cleaning member including a rotation shaft and a wiper extending from the rotation shaft in a radius direction to wipe the light exit surface and the light incident surface based on a rotation of the rotation shaft, a first power transmission member coupled to the rotation shaft, and a second power transmission member configured to engage with the first power transmission member to intermittently rotate the cleaning member.

The cartridge may further include a reference location provider configured to provide a reference location in such a manner that the wiper is provided at a location separated from the light exit surface and the light incident surface.

The cartridge may further include a housing configured to support the rotation shaft, the reference location provider may include a first indicator provided on the first power transmission member, and a second indicator provided on a side wall of the housing, and the wiper may be provided at the location separated from the light exit surface and the light incident surface, by aligning the first and second indicators.

The reference location provider may include a first indicator provided on the first power transmission member, and a second indicator provided on the second power transmission member, and the wiper may be provided at the location separated from the light exit surface and the light incident surface, by aligning the first indicator with the second indicators.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
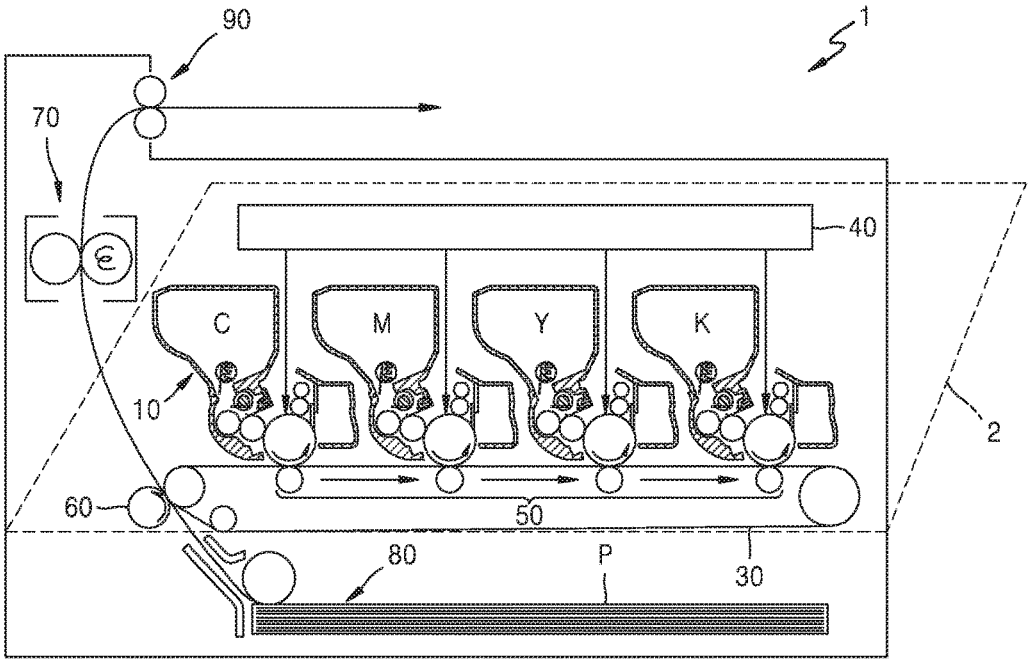
FIG. 1 is a structural view of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Figure 2A:
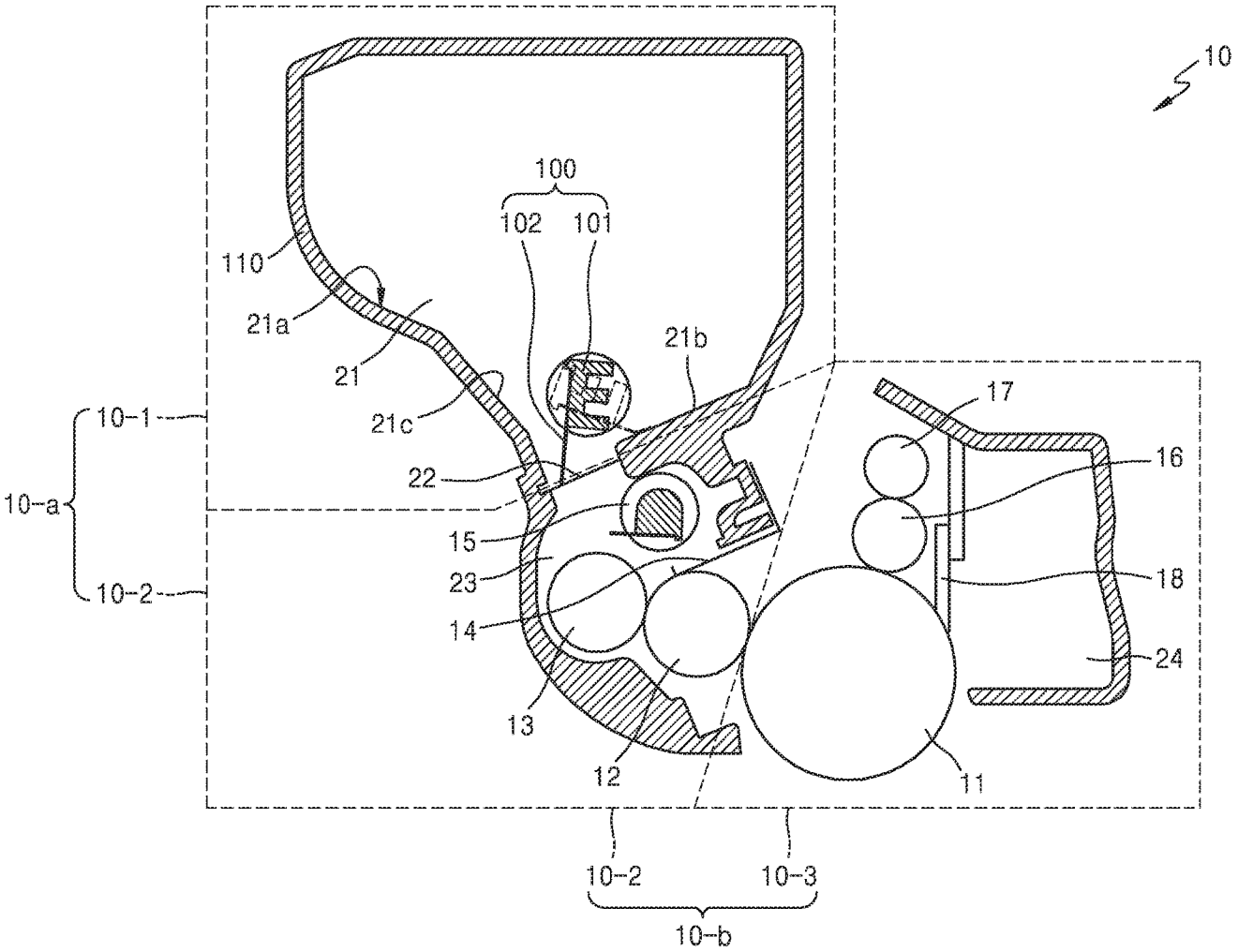
FIG. 2A is a structural view of a process cartridge according to an embodiment.

FIG. 1 is a structural view of an electrophotographic image forming apparatus according to an embodiment. The image forming apparatus according to the embodiment prints color images using electrophotography. FIG. 2A is a structural view of a process cartridge 10 according to an embodiment.

Referring to FIGS. 1 and 2A, the image forming apparatus includes a body 1 and a plurality of process cartridges 10 mountable in the body 1. For example, a front part of the body 1 may be opened by opening a door 2, and the process cartridges 10 may be mounted in the body 1. Although not shown in FIG. 1, the door 2 may be used to open a side part or a top part of the body 1.

The process cartridges 10 may include a plurality of process cartridges 10C, 10M, 10Y, and 10K for developing cyan (C), magenta (M), yellow (Y), and black (K) toners, respectively. However, the scope of the present disclosure is not limited thereto, and the image forming apparatus may further include a plurality of process cartridges 10 for containing and developing toners of various colors other than the above-mentioned colors, e.g., light magenta and white. In the following description, it is assumed that the image forming apparatus includes the process cartridges 10C, 10M, 10Y, and 10K, and C, M, Y, and K following reference numerals denote elements for developing cyan, magenta, yellow, and black toners, respectively, unless the context clearly indicates otherwise.

Each of the process cartridges 10 may include a toner container 21 and a developing section 23. A toner contained in the toner container 21 is supplied to the developing section 23 through a supply port 22.

The toner container 21 includes a stirring member 100 for stirring and providing the toner to the developing section 23. The developing section 23 may include a photosensitive drum 11 for forming an electrostatic latent image on a surface thereof, and a developing roller 12 for developing the electrostatic latent image into a visible toner image by supplying the toner in the developing section 23 to the electrostatic latent image. The photosensitive drum 11 is an example of a photoconductor for forming an electrostatic latent image on a surface thereof, and may include a conductive metal pipe, and a photosensitive layer provided on an outer circumferential surface of the conductive metal pipe.

The surface of the photosensitive drum 11 is charged by a charger to have a uniform surface potential. A charging roller 16 is an example of the charger. A charging brush, a corona charger, or the like may be used instead of the charging roller 16. The process cartridge 10 may further include a charging roller cleaner 17 for removing a foreign substance adhered to the charging roller 16, e.g., the toner or dust. The charging roller cleaner 17 may be, for example, a roller rotating in contact with the charging roller 16.

The process cartridge 10 may further include a cleaning member 18 for removing the toner remaining on the surface of the photosensitive drum 11 after an intermediate transfer operation to be described below, and a waste toner container 24 for containing the toner removed from the photosensitive drum 11.

The developing section 23 may include a supply roller 13 for supplying the toner in the developing section 23 to the developing roller 12. A regulation member 14 regulates the amount of the toner supplied to a developing area where the photosensitive drum 11 and the developing roller 12 face each other. The developing section 23 may further include a developing section stirring member 15 for stirring the toner in the developing section 23. The developing section stirring member 15 stirs the toner in the developing section 23 and supplies the same to the supply roller 13. For example, the developing section stirring member 15 may have the same configuration as the stirring member 100.

For example, the process cartridge 10 may be divided into a toner cartridge 10-1 including the toner container 21, a developing cartridge 10-2 including the developing section 23, and a photoconductor cartridge 10-3 including the photosensitive drum 11 and the waste toner container 24. In this case, the toner cartridge 10-1, the developing cartridge 10-2, and the photoconductor cartridge 10-3 may be individually mounted in the body 1. In addition, the toner cartridge 10-1 may be mounted on the developing cartridge 10-2.

For example, the process cartridge 10 may be divided into a developing cartridge **10-*a* provided as an integration of the toner cartridge 10-1 and the developing cartridge 10-2, and the photoconductor cartridge 10-3. In this case, the developing cartridge 10-*a* and the photoconductor cartridge 10-3 may be individually mounted in the body 1**.

As an example, the process cartridge 10 may be divided into the toner cartridge 10-1, and an imaging cartridge **10-*b* including the developing cartridge 10-2 and the photoconductor cartridge 10-3. In this case, the toner cartridge 10-1 and the imaging cartridge 10-*b* may be individually mounted in the body 1. In addition, the toner cartridge 10-1 may be mounted on the imaging cartridge 10-*b***.

As an example, the process cartridge 10 may be a single process cartridge provided as an integration of the toner cartridge 10-1, the developing cartridge 10-2, and the photoconductor cartridge 10-3.

A developing scheme of the image forming apparatus according to an embodiment has been described above in detail. However, the developing scheme is not limited thereto and may be variously changed or modified.

An exposer 40 is an element for forming electrostatic latent images on the photosensitive drums 11 by irradiating light modified to correspond to image information, onto the photosensitive drums 11. A representative example thereof is a laser scanning unit (LSU) using a laser diode as a light source, or a light emitting diode (LED) exposer using an LED as a light source.

An intermediate transfer belt 30 temporarily contains toner images developed on the photosensitive drums 11 of the process cartridges 10C, 10M, 10Y, and 10K. A plurality of intermediate transfer rollers 50 are provided to face the photosensitive drums 11 of the process cartridges 10C, 10M, 10Y, and 10K with respect to the intermediate transfer belt 30 intervened therebetween. An intermediate transfer bias voltage, for intermediately transferring the images developed on the photosensitive drums 11 onto the intermediate transfer belt 30, is applied to the intermediate transfer rollers 50. Corona transferers or pin-scorotron transferers may be used instead of the intermediate transfer rollers 50.

A transfer roller 60 is located to face the intermediate transfer belt 30. A transfer bias voltage, for transferring the toner images transferred onto the intermediate transfer belt 30 onto a recording medium P, is applied to the transfer roller 60.

Although the images developed on the photosensitive drums 11 are intermediately transferred onto the intermediate transfer belt 30 and then are transferred onto the recording medium P passing between the intermediate transfer belt 30 and the transfer roller 60 in the above description according to an embodiment, the present disclosure is not limited thereto. The recording medium P may directly pass between the intermediate transfer belt 30 and the photosensitive drums 11 and thus the developed images may be directly transferred onto the recording medium P. In this case, the transfer roller 60 is not used.

A fuser 70 applies heat and/or pressure to the toner images transferred onto the recording medium P, and thus fixes the toner images on the recording medium P. The fuser 70 is not limited to the type illustrated in FIG. 1.

A brief description is now given of an image forming operation using the above-described configuration.

The charging rollers 16 charge the photosensitive drums 11 of the process cartridges 10C, 10M, 10Y, and 10K to uniform surface potentials.

The exposer 40 forms electrostatic latent images on the photosensitive drums 11 of the process cartridges 10C, 10M, 10Y, and 10K by irradiating light, modified to correspond to image information of a plurality of colors, onto the photosensitive drums 11. The electrostatic latent images of the photosensitive drums 11 of the process cartridges 10C, 10M, 10Y, and 10K are developed into visible toner images due to the C, M, Y, and K toners contained in the process cartridges 10C, 10M, 10Y, and 10K. The developed toner images are sequentially and intermediately transferred onto the intermediate transfer belt 30. The recording medium P accommodated in a paper tray 80 is fed between the transfer roller 60 and the intermediate transfer belt 30. The toner images intermediately transferred onto the intermediate transfer belt 30 are transferred onto the recording medium P due to a transfer bias voltage applied to the transfer roller 60. After the recording medium P passes through the fuser 70, the toner images are fixed on the recording medium P due to heat and pressure. The recording medium P, on which the toner images are completely fixed, is discharged by discharge rollers 90.

Referring to FIG. 2A, the stirring member 100 for stirring the toner is provided in the toner container 21. The stirring member 100 may include a rotation shaft 101 and a stirring film 102 extending from the rotation shaft 101 in a radius direction. The rotation shaft 101 may be rotatably supported by, for example, a housing 110. The stirring film 102 has elasticity. The stirring film 102 contacts an internal wall 21*a* of the toner container 21 in at least a predetermined period while the stirring member 100 makes one full turn. For example, as indicated by a dashed line in FIG. 2A, the stirring film 102 contacts a part 21*b* of the internal wall 21*a* close to the supply port 22 and thus is elastically bent. The part 21*b* may be provided at an upstream side of the supply port 22 based on a rotation direction of the stirring member 100. After the contact between the part 21*b* and the stirring film 102 has terminated, the stirring film 102 is straightened to an original state thereof and the toner is splashed due to elasticity of the stirring film 102. As such, the toner may be stirred and, at the same time, appropriately supplied from the toner container 21 to the developing section 23 through the supply port 22. The stirring film 102 may also contact a part 21*c* provided at a downstream side of the supply port 22 based on the rotation direction of the stirring member 100. As such, stirring performance of the stirring member 100 may be improved.

In a printing operation, the stirring member 100 may rotate at a rate capable of appropriately maintaining the toner in a powder state without forming a mass in order for the toner to be supplied from the toner container 21 to the developing section 23. In addition, the developing section stirring member 15 may rotate at a rate capable of appropriately supplying the toner from the developing section 23 to the supply roller 13.

If the stirring member 100 rotates excessively, physical stress is applied to the toner due to friction between the stirring film 102 and the toner. As such, the properties of the toner may deteriorate and thus the quality of printing may be lowered. For example, the toner may not be appropriately transferred in the transfer operation and thus a transfer error, e.g., a partial omission or a non-uniform density of a printed image, may be generated. In addition, due to excessive supply of the toner to the developing section 23, the pressure of the toner in the developing section 23 may be raised and thus driving loads may be increased. Excessive or insufficient rotation of the stirring member 100 may cause a supply error. The supply error may cause a non-uniform density of a printed image based on a rotation cycle of the stirring member 100. Accordingly, rotations of the stirring member 100 need to be restricted.

Excessive rotation of the developing section stirring member 15 may also apply stress to the toner in the developing section 23, deteriorate the properties of the toner, and cause a transfer error. In addition, excessive or insufficient rotation of the developing section stirring member 15 may cause a supply error. Accordingly, rotations of the developing section stirring member 15 need to be restricted.

A rotation ratio of the developing section stirring member 15 to the supply roller 13 may be from approximately 50% to approximately 100%. If the rotation ratio of the developing section stirring member 15 to the supply roller 13 is less than approximately 50%, the amount of the toner supplied to the supply roller 13 may be reduced and thus the density of the image may be lowered. If the rotation ratio of the developing section stirring member 15 to the supply roller 13 is greater than approximately 100%, an excessive amount of the toner may be supplied to the supply roller 13 to cause a supply error and thus the stress applied to the toner may be increased.

By restricting the rotation ratio of the developing section stirring member 15 to the supply roller 13 as described above, possibilities of a supply error and a transfer error may be reduced and stable image quality may be achieved.

Table 1 shows test results about whether a transfer error and a supply error are generated in a case when the rotation ratio of the developing section stirring member 15 to the supply roller 13 is fixed to 61.5% and a rotation ratio of the stirring member 100 to the supply roller 13 varies.

TABLE 1

| Rotation ratio of stirring member to supply roller (%) rotation ratio | Error-generated timing (Number of printed pages) | | | Average toner consumption (g)/ 1K printed pages | Average waste toner generation (g)/ 1K printed pages |
|---|---|---|---|---|---|
| | Transfer error | Supply error | Test ended | | |
| 9.8% | Not generated | 18K | 18K | 5.3 | 1.4 |
| 13% | Not generated | 16.5K | 18K | 5.4 | 1.7 |
| 19.6% | 18K | 16.5K | 18K | 5.8 | 1.9 |
| 61.5% | 15K | 12K | 15K | 7.8 | 3.4 |

Referring to Table 1, during the rotation ratio of the stirring member 100 to the supply roller 13 is increased from 9.8% to 19.6%, a transfer error and a supply error are generated at a timing when approximately 18000 and 16500 pages are printed. However, when the rotation ratio of the stirring member 100 to the supply roller 13 is 61.5% (when the developing section stirring member 15 and the stirring member 100 have a rotation ratio of 1:1), a supply error is generated at a timing when approximately 12000 pages are printed and a transfer error is also generated at a timing when approximately 15000 pages are printed. That is, the number of pages printed before a supply error is generated due to excessive rotation of the stirring member 100 varies by approximately 8.3% during the rotation ratio of the stirring member 100 to the supply roller 13 is almost doubled from 9.8% to 19.6%, but varies by approximately 27% during the rotation ratio of the stirring member 100 to the supply roller 13 is almost tripled from 19.6% to 61.5%.

In addition, during the rotation ratio of the stirring member 100 to the supply roller 13 is increased from 9.8% to 19.6%, an average toner consumption and an average waste toner generation per 1000 printed pages are slightly increased. However, when the rotation ratio of the stirring member 100 to the supply roller 13 is 61.5%, i.e., when the developing section stirring member 15 and the stirring member 100 have a rotation ratio of 1:1, the average toner consumption and the average waste toner generation per 1000 printed pages are rapidly increased. That is, the average toner consumption and the average waste toner generation per 1000 printed pages are increased by approximately 0.5 g during the rotation ratio of the stirring member 100 to the supply roller 13 is almost doubled from 9.8% to 19.6%, but are increased by 2.0 g and 1.5 g during the rotation ratio of the stirring member 100 to the supply roller 13 is almost tripled from 19.6% to 61.5%.

In consideration of the above test results, the rotation ratio of the stirring member 100 to the supply roller 13 may be set from approximately 5% to approximately 25%. A rotation ratio of the stirring member 100 to the developing section stirring member 15 may be from approximately 12.5% to approximately 25%. If the rotation ratio of the stirring member 100 to the supply roller 13 is less than approximately 5%, the toner in the toner container 21 may form a mass, the amount of the toner supplied to the developing section 23 may be reduced, and thus the density of a printed image may be lowered. If the rotation ratio of the stirring member 100 to the supply roller 13 is greater than approximately 25%, a possibility of a supply error may be increased due to an excessive amount of the toner supplied to the developing section 23, and a possibility of a transfer error may also be increased due to stress of the toner. In addition, a toner consumption rate and a waste toner generation rate may be increased.

By restricting the rotation ratio of the stirring member 100 to the supply roller 13 as described above, possibilities of a supply error and a transfer error may be reduced and stable image quality may be achieved. In addition, a toner consumption rate and a waste toner generation rate may be reduced.

Figure 2B:
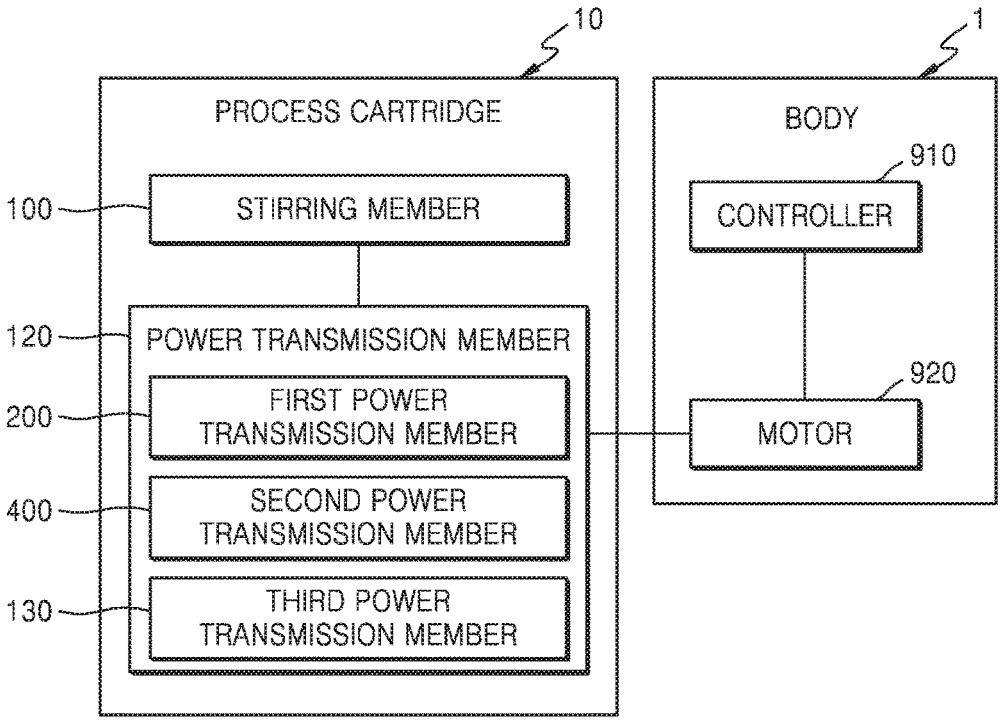
FIG. 2B is a block diagram of the image forming apparatus according to an embodiment.

The rotation ratio may be controlled by a power transmission member 120 (see FIG. 2B) for interconnecting the supply roller 13, the developing section stirring member 15, and the stirring member 100. FIG. 2B is a block diagram of the image forming apparatus according to an embodiment. Referring to FIG. 2B, the power transmission member 120 may include first, second, and third power transmission members 200, 400, and 130. For example, the first power transmission member 200 is provided on the rotation shaft 101 of the stirring member 100. The second power transmission member 400 is provided on a rotation shaft of the developing section stirring member 15. The third power transmission member 130 is provided on a rotation shaft of the supply roller 13. When the process cartridge 10 is mounted in the body 1, the power transmission member 120 is power-connected to a motor 920 included in the body 1. A controller 910 may drive the motor 920 to rotate the supply roller 13, the developing section stirring member 15, and the stirring member 100.

For example, the first, second, and third power transmission members 200, 400, and 130 may be gears sequentially engaged with each other. In this case, the numbers of teeth of the second and third power transmission members 400 and 130 are determined in such a manner that the rotation ratio of the developing section stirring member 15 to the supply roller 13 is from approximately 50% to approximately 100%. The numbers of teeth of the first and second power transmission members 200 and 400 may be determined in such a manner that the rotation ratio of the stirring member 100 to the supply roller 13 is from approximately 5% to approximately 25%. In this case, one or more reduction gears may be provided between the first and second power transmission members 200 and 400, and the numbers of teeth of the first and second power transmission members 200 and 400 and the reduction gears may be determined in such a manner that the rotation ratio of the stirring member 100 to the supply roller 13 is from approximately 5% to approximately 25%. Based on the above-described gear connection structure, the supply roller 13, the developing section stirring member 15, and the stirring member 100 continuously rotate.

The power transmission member 120 is not limited to a gear connection structure. To satisfy the above-described rotation ratios of the developing section stirring member 15 and the stirring member 100 to the supply roller 13, a variety of power transmission structures may be used.

To reduce stress applied to the toner in the toner container 21, the stirring member 100 may rotate at a minimum as long as the toner is appropriately suppliable to the developing section 23. That is, the stirring member 100 does not always need to continuously rotate as long as the stirring member 100 rotates at the above-described rotation ratio. The process cartridge 10 according to the current embodiment has a structure capable of intermittently rotating the stirring member 100. As such, stress of the toner may be further reduced.

Figure 3:
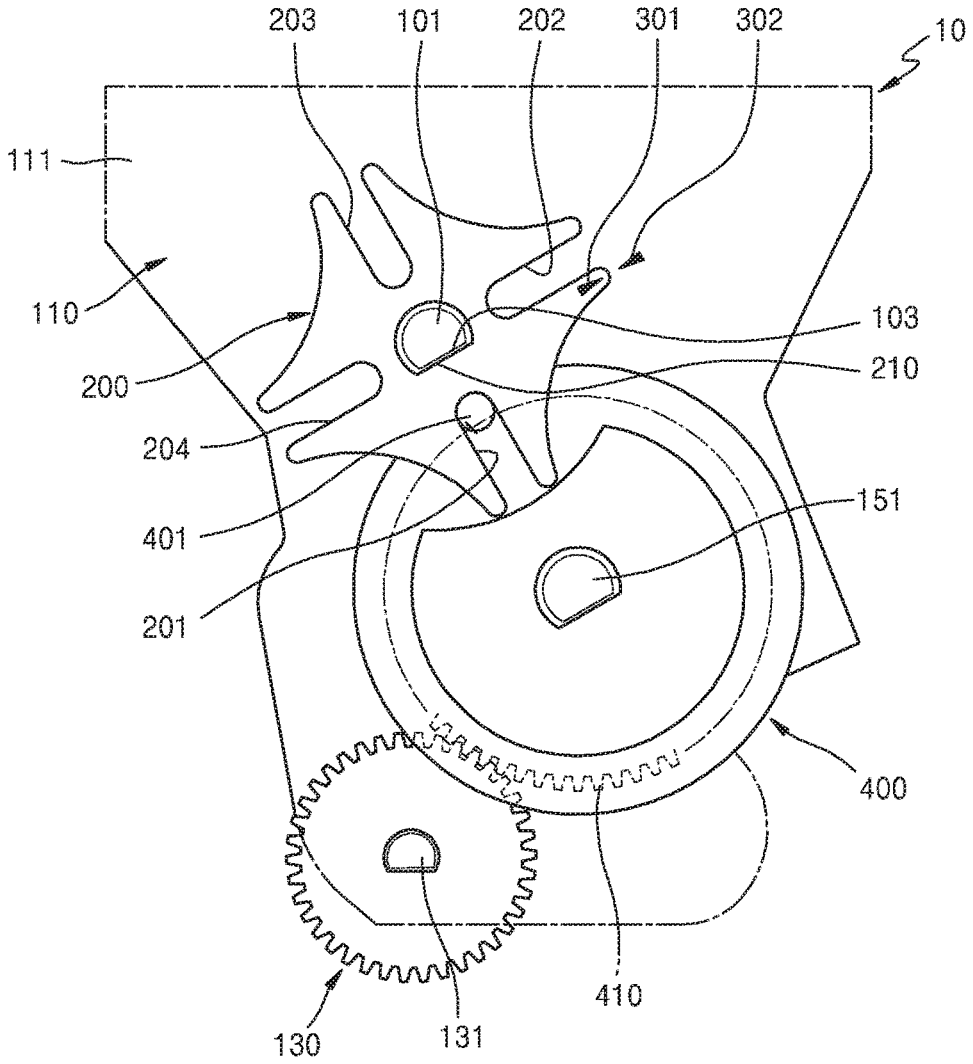
FIG. 3 is a side view of a process cartridge according to an embodiment.

FIG. 3 is a side view of the process cartridge 10 according to an embodiment. Referring to FIG. 3, the first power transmission member 200 is coupled to the rotation shaft 101 of the stirring member 100. When the process cartridge 10 is mounted in the body 1, the first power transmission member 200 rotates by receiving power from the body 1. For example, the second power transmission member 400 may be coupled to a rotation shaft 151 of the developing section stirring member 15 and is connected to the third power transmission member 130 provided on a rotation shaft 131 of the supply roller 13. The third power transmission member 130 may be provided as, for example, a gear, and the second power transmission member 400 may include a gear part 410 engaged with the third power transmission member 130. When the process cartridge 10 is mounted in the body 1, a driving force of the motor 920 may be transmitted to the first power transmission member 200 via the third power transmission member 130 and the second power transmission member 400.

The second power transmission member 400 is connected to the first power transmission member 200 to intermittently rotate the first power transmission member 200. "Intermittent rotation" refers to the first power transmission member 200 having a rotation period and a non-rotation period while the second power transmission member 400 makes one full turn.

For example, the first power transmission member 200 includes four slots 201, 202, 203, and 204 extending in radius directions and having open ends. The four slots 201 to 204 may be provided to form equal angles therebetween. In the current embodiment, the four slots 201 to 204 are provided to form 90° therebetween. The second power transmission member 400 includes a pin 401. The first power transmission member 200 may rotate only when the pin 401 is inserted into one of the slots 201 to 204. That is, when the pin 401 is spaced apart from the slots 201 to 204, even though the second power transmission member 400 rotates, the first power transmission member 200 does not rotate.

Figure 4:
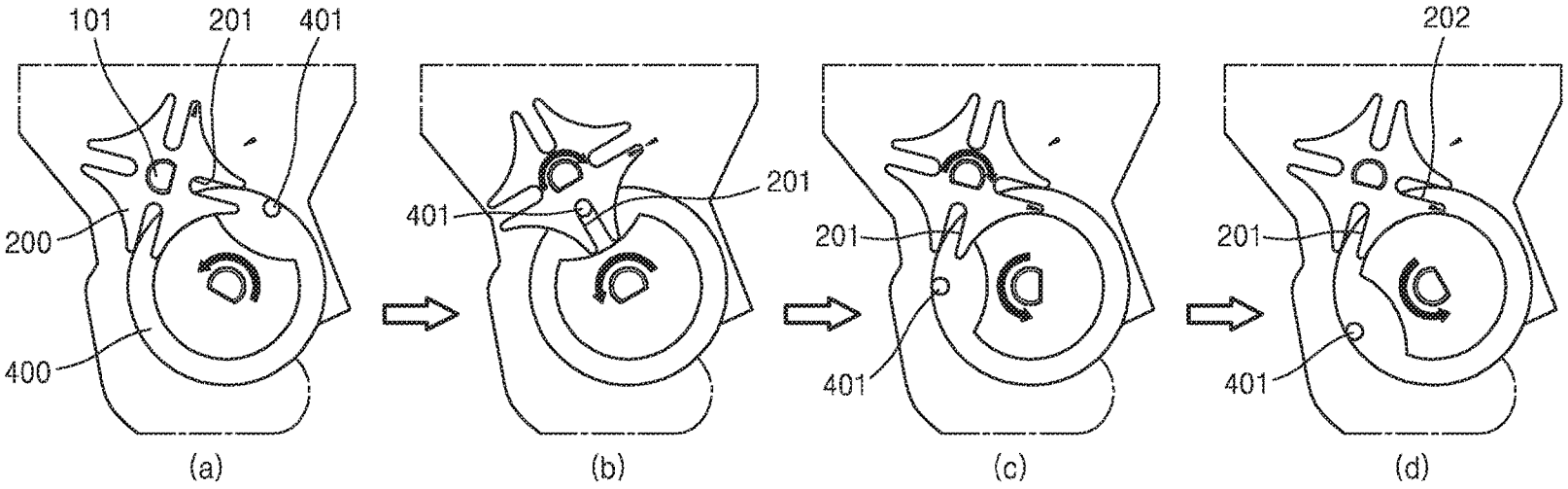
FIG. 4 is a diagram showing operations of first and second power transmission members.

FIG. 4 is a diagram showing operations of the first and second power transmission members 200 and 400. Referring to FIG. 4, before the pin 401 is inserted into the slot 201, even though the second power transmission member 400 rotates, the first power transmission member 200 does not rotate (FIG. 4 part (a)). When the pin 401 is inserted into the slot 201, the pin 401 pushes the slot 201 and thus the first power transmission member 200 starts to rotate (FIG. 4 part (b)). When the pin 401 leaves the slot 201 after the first power transmission member 200 rotates by a predetermined angle (FIG. 4 part (c)), even though the second power transmission member 400 rotates, the first power transmission member 200 does not rotate. Until the second power transmission member 400 makes one full turn and thus the pin 401 is inserted into the slot 202, the first power transmission member 200 is maintained in the stopped state (FIG. 4 part (d)).

According to the above-described configuration, while the second power transmission member 400 makes four full turns, the pin 401 is inserted sequentially into the slots 201 to 204 and thus the first power transmission member 200 intermittently rotates by 90° four times to make one full turn. As such, a rotation ratio of the stirring member 100 to the developing section stirring member 15 is 25%. Accordingly, because a rotation time of the stirring member 100 in a printing operation is ¼ of that of the developing section stirring member 15, stress applied to the toner due to rotation of the stirring member 100 may be reduced and thus the properties of the toner may be maintained for a long time.

According to the intermittent rotation structure of the current embodiment, because deceleration is achieved and the stirring member 100 has a non-rotation period, a rotation speed and a rotation time of the stirring member 100 may be reduced and thus stress applied to the toner may be further reduced. In addition, according to the current embodiment, by employing the intermittent rotation structure using slots and a pin, a large reduction ratio may be achieved within a small space. Accordingly, a large reduction ratio may be achieved without increasing the size of the process cartridge 10.

The process cartridge 10 may be packaged together with or separately from the body 1 before being sold. When the process cartridge 10 is produced, if the stirring member 100 is packaged in a state that the stirring film 102 contacts the part 21*b* or the part 21*c*, the stirring film 102 is maintained in a bent state in contact with the part 21*b* or the part 21*c* before a user purchases and inserts the process cartridge 10 into the body 1 and starts a printing operation. If the bent state is maintained for a long time as described above, the stirring film 102 may be permanently deformed to the bent state. In this case, toner stirring performance and toner supply performance of the stirring member 100 may deteriorate.

According to the current embodiment, when the process cartridge 10 is produced, the stirring member 100 is assembled to the housing 110 in such a manner that the stirring film 102 does not contact the internal wall 21*a* of the toner container 21. To this end, the process cartridge 10 includes a reference location provider for providing a reference location in such a manner that the stirring film 102 is provided at a location not contacting the internal wall 21*a* of the toner container 21.

For example, referring to FIG. 3, the reference location provider may include a first indicator 301 provided on the first power transmission member 200, and a second indicator 302 provided on a side wall 111 of the housing 110.

The first indicator 301 is not particularly limited to any form as long as the first indicator 301 is distinguishable from the other parts of the first power transmission member 200. For example, the first indicator 301 may be implemented as a convex or concave mark on the first power transmission member 200. In addition, the second indicator 302 is not particularly limited to any form and may be implemented as, for example, a convex or concave mark on the side wall 111 of the housing 110.

The first power transmission member 200 and the stirring member 100 are always coupled to each other at the same coupling location. For example, a first coupling indicator 103 is provided on the rotation shaft 101, and a second coupling indicator 210 is provided on the first power transmission member 200. If the first power transmission member 200 and the stirring member 100 are coupled to each other by aligning the first and second coupling indicators 103 and 210, a relative location between the first indicator 301 and the stirring film 102 is correspondingly determined. For example, the first coupling indicator 103 may be implemented as a D-cut portion provided at an end of the rotation shaft 101, and the second coupling indicator 210 may be implemented as a hole having a shape complementary to the D-cut portion. The first and second coupling indicators 103 and 210 are not limited to the shapes illustrated in FIG. 3, and may have any shapes capable of providing reference coupling locations of the stirring member 100 and the first power transmission member 200 in such a manner that the a relative location between the first indicator 301 and the stirring film 102 is correspondingly determined.

According to the above-described configuration, when the process cartridge 10 is produced, the stirring film 102 may be provided at a location not contacting the internal wall 21*a* of the toner container 21, e.g., a location indicated by a solid line in FIG. 2A, by aligning the first and second indicators 301 and 302 with each other after the stirring member 100 is assembled to the housing 110. If the first and second indicators 301 and 302 are aligned with each other, the stirring film 102 is not particularly limited to any location as long as the stirring film 102 does not contact the internal wall 21*a* of the toner container 21.

Figure 5:
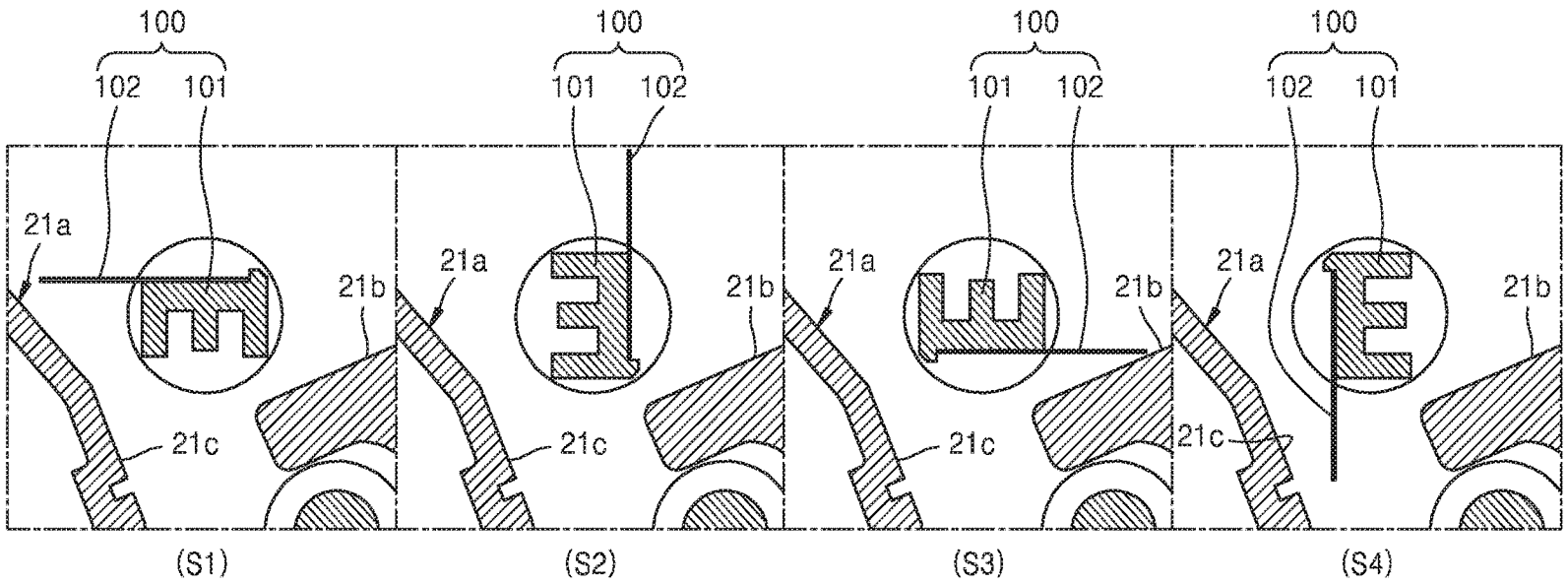
FIG. 5 is a diagram showing an example of four stop locations of a stirring member.

In the above-described embodiment, the stirring member 100 has four stop locations while the first power transmission member 200 makes one full turn. FIG. 5 is a diagram showing an example of four stop locations s1, s2, s3, and s4 of the stirring member 100. As illustrated in FIG. 5, the four stop locations s1 to s4 are spaced apart from each other to form 90° therebetween, and may be locations where the stirring film 102 does not contact the internal wall 21*a* of the toner container 21. According to the above-described configuration, the pin 401 and each of the slots 201 to 204 may serve as the first indicator 301 and the second indicator 302, respectively, and the first and second indicators 301 and 302 illustrated in FIG. 3 may not be necessary. When the process cartridge 10 is produced, if the pin 401 and the slots 201 to 204 are aligned in a state that the pin 401 is not inserted into one of the slots 201 to 204, i.e., the state of FIG. 4 part (a), part (c), or part (d), the stirring film 102 may not contact the internal wall 21*a* of the toner container 21.

Figure 6:
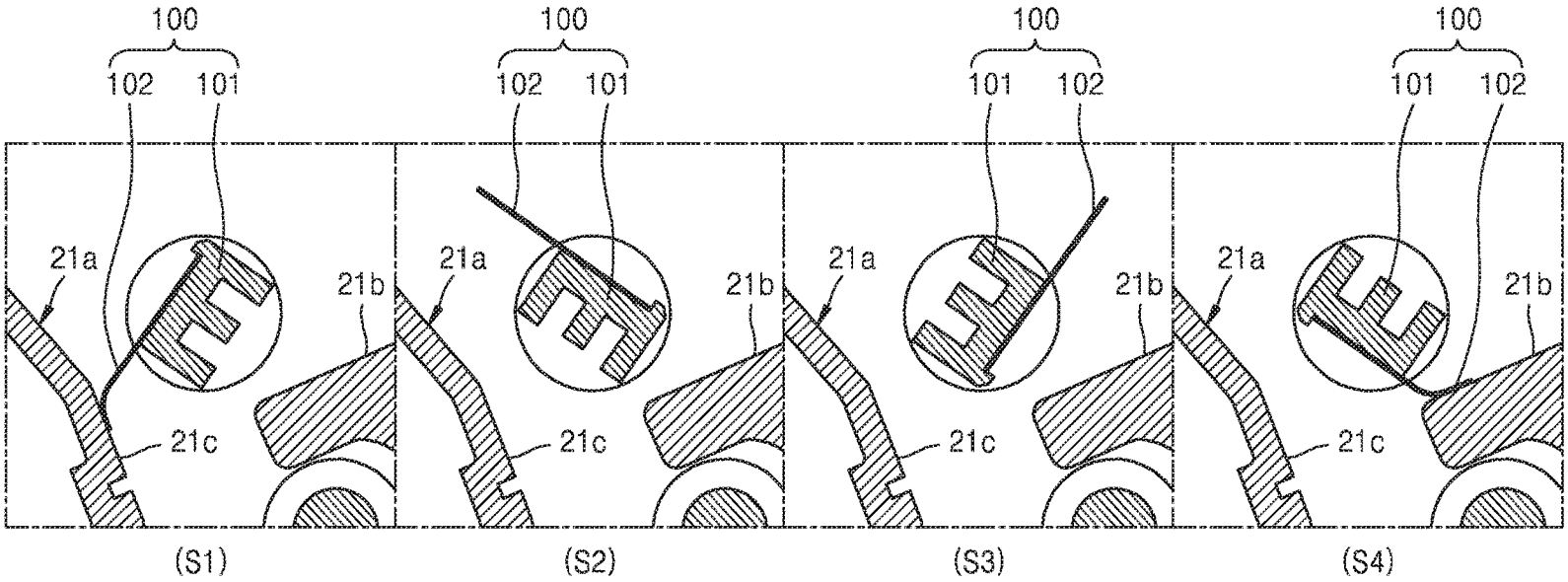
FIG. 6 is a diagram showing an example of the four stop locations of the stirring member.

Not all of the four stop locations s1 to s4 need to be locations where the stirring film 102 does not contact the internal wall 21*a* of the toner container 21. FIG. 6 is a diagram showing an example of the four stop locations s1, s2, s3, and s4 of the stirring member 100. As illustrated in FIG. 6, the four stop locations s1 to s4 are spaced apart from each other to form 90° therebetween. The stirring film 102 contacts the parts 21*c* and 21*b* of the internal wall 21*a* of the toner container 21 at the stop locations s1 and s4, respectively, and does not contact the internal wall 21*a* of the toner container 21 at the stop locations s2 and s3. In this case, the reference location provider may be implemented to locate the stirring member 100 at the stop location s2 or s3. To this end, the first and second indicators 301 and 302 may be provided on the first and second power transmission members 200 and 400, respectively.

Figure 7:
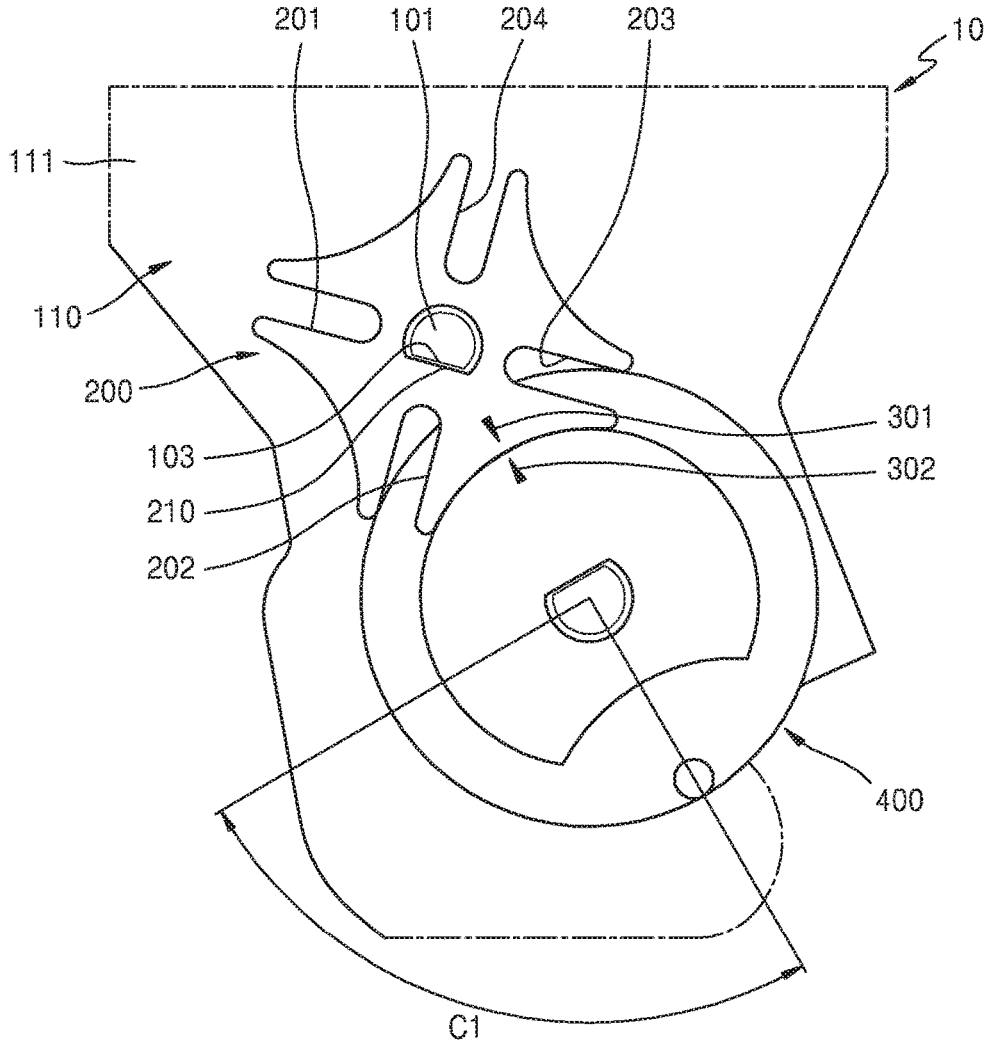
FIG. 7 is a side view of the process cartridge according to an embodiment.

FIG. 7 is a side view of the process cartridge 10 according to an embodiment. Referring to FIG. 7, for example, the first and second indicators 301 and 302 are provided on the first and second power transmission members 200 and 400, respectively, in such a manner that the stirring member 100 is provided at the stop location s2 of FIG. 6. For example, the first indicator 301 is provided between the slots 202 and 203, and the second indicator 302 is provided at a location outside a section c1 where the pin 401 and one of the slots 201 to 203 is connected to each other. Based on the above-described configuration, when the process cartridge 10 is produced, the stirring film 102 may not contact the internal wall 21*a* of the toner container 21 by aligning the first and second indicators 301 and 302 with each other.

Although not shown in FIG. 6, the first and second indicators 301 and 302 may be provided on the first and second power transmission members 200 and 400, respectively, in such a manner that the stirring member 100 is provided at the stop location s3 of FIG. 6. In this case, the first indicator 301 is provided between the slots 203 and 204, and the second indicator 302 is provided at a location outside the section c1 where the pin 401 and one of the slots 201 to 203 is connected to each other.

Although an intermittent rotation structure having a reduction ratio of 4:1 is implemented using a combination of four slots 201 to 204 and one pin 401 in the above-described embodiments, the numbers of slots and pins are not limited to those of above-described embodiments. For example, an intermittent rotation structure having a reduction ratio of 6:1 may be implemented using a combination of six slots provided to form 60° therebetween, and one pin. The numbers of slots and pins may be determined in such a manner that the stirring member 100 intermittently rotates at an appropriate reduction ratio.

As described above, by employing the reference location provider, the process cartridge 10 may be assembled in a state that the stirring film 102 does not contact the internal wall 21*a* of the toner container 21. Accordingly, deformation of the stirring film 102 in a distribution process of the process cartridge 10 after the process cartridge 10 is produced may be prevented.

After the process cartridge 10 is mounted in the body 1 and a printing operation starts, the stirring member 100 intermittently rotates based on the above-described structure. When the printing operation has terminated, the stirring member 100 stops rotating. In this case, if the stirring member 100 stops rotating in a state that the stirring film 102 contacts the part 21*b* or 21*c* of the internal wall 21*a*, the stirring film 102 may be maintained in a bent state until a next printing operation starts, and thus may deform. The stirring member 100 may be controlled to stop rotating in a state that the stirring film 102 does not contact the internal wall 21*a*.

Figure 8:
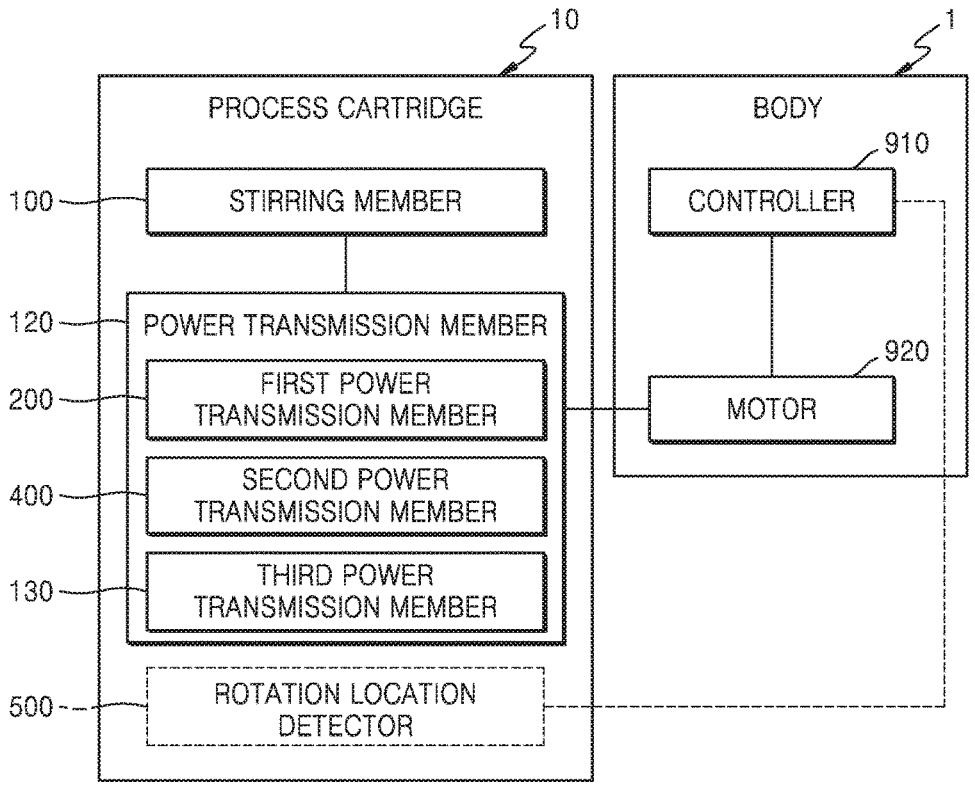
FIG. 8 is a block diagram of the image forming apparatus according to an embodiment.

FIG. 8 is a block diagram of the image forming apparatus according to an embodiment. Referring to FIG. 8, the body 1 includes the motor 920 for rotating the stirring member 100. When the process cartridge 10 is mounted in the body 1, the stirring member 100 is connected to the motor 920 via the power transmission member 120. For example, a driving force of the motor 920 may be intermittently transmitted to the stirring member 100 via the second and first power transmission members 400 and 200. The controller 910 controls the motor 920 to stop the stirring member 100 at a location where the stirring film 102 does not contact the internal wall 21*a* of the toner container 21.

For example, if at least one of a plurality of stop locations of the stirring member 100 corresponds to a location where the stirring film 102 does not contact the internal wall 21*a* of the toner container 21, the controller 910 may control the motor 920 to stop the stirring member 100 at the stop location.

Alternatively, the controller 910 may control the motor 920 to stop the stirring member 100 at a reference location. For example, in the embodiment of FIG. 3, if a unit driving time of the motor 920 taken to rotate the stirring member 100 by one full turn is t1, the controller 910 may stop the motor 920 after driving the motor 920 by an integer multiple of t1. That is, when driving of the motor 920 starts, the controller 910 calculates an accumulated driving time thereof. If the printing operation has terminated, the controller 910 stops driving the motor 920 at a timing when the accumulated driving time is an integer multiple of t1. As such, the stirring member 100 always stops at the reference location. The unit driving time t1 may be determined based on deceleration of the power transmission member 120 provided from the motor 920 to the stirring member 100.

If the stirring film 102 does not contact the internal wall 21*a* of the toner container 21 at all stop locations of the stirring member 100 as illustrated in FIG. 5, the controller 910 may stop the motor 920 after driving the motor 920 by an integer multiple of t2, where t2 indicates a unit driving time of the motor 920 taken to rotate the second power transmission member 400 by one full turn.

If the stirring film 102 does not contact the internal wall 21*a* of the toner container 21 at a part of a plurality of stop locations of the stirring member 100 as illustrated in FIG. 6, the controller 910 may stop the motor 920 after driving the motor 920 by an integer multiple of a time obtained by a reduction ratio between the first and second power transmission members 200 and 400×t2, where t2 indicates a unit driving time of the motor 920 taken to rotate the second power transmission member 400 by one full turn.

Because the stirring member 100 always starts to rotate at the reference location due to the reference location provider, if the motor 920 is controlled as described above, the stirring member 100 may always stop rotating at the reference location.

The process cartridge 10 may further include a rotation location detector 500 for detecting a rotation location of the stirring member 100. The rotation location detector 500 may be implemented as, for example, one or more detecting projections provided on the stirring member 100, and a detection sensor for detecting the detecting projections. The detection sensor may detect the rotation location of the stirring member 100 by detecting the detecting projections in, for example, an optical detection scheme, a magnetic detection scheme, or an electrical-contact detection scheme. For example, the rotation location detector 500 may detect a reference location. In this case, the rotation location detector 500 may be implemented as one detecting projection aligned with the reference location, and one optical sensor for detecting the detecting projection. Because the number of rotations of the first power transmission member 200 is the same as the number of rotations of the stirring member 100, the detecting projections may be alternatively provided on the first power transmission member 200.

According to the above-described configuration, the controller 910 may stop the stirring member 100 at a location where the stirring film 102 does not contact the internal wall 21*a* of the toner container 21, by receiving a detection signal of the rotation location detector 500 and stopping the motor 920 at a timing when the reference location is detected.

Figure 9:
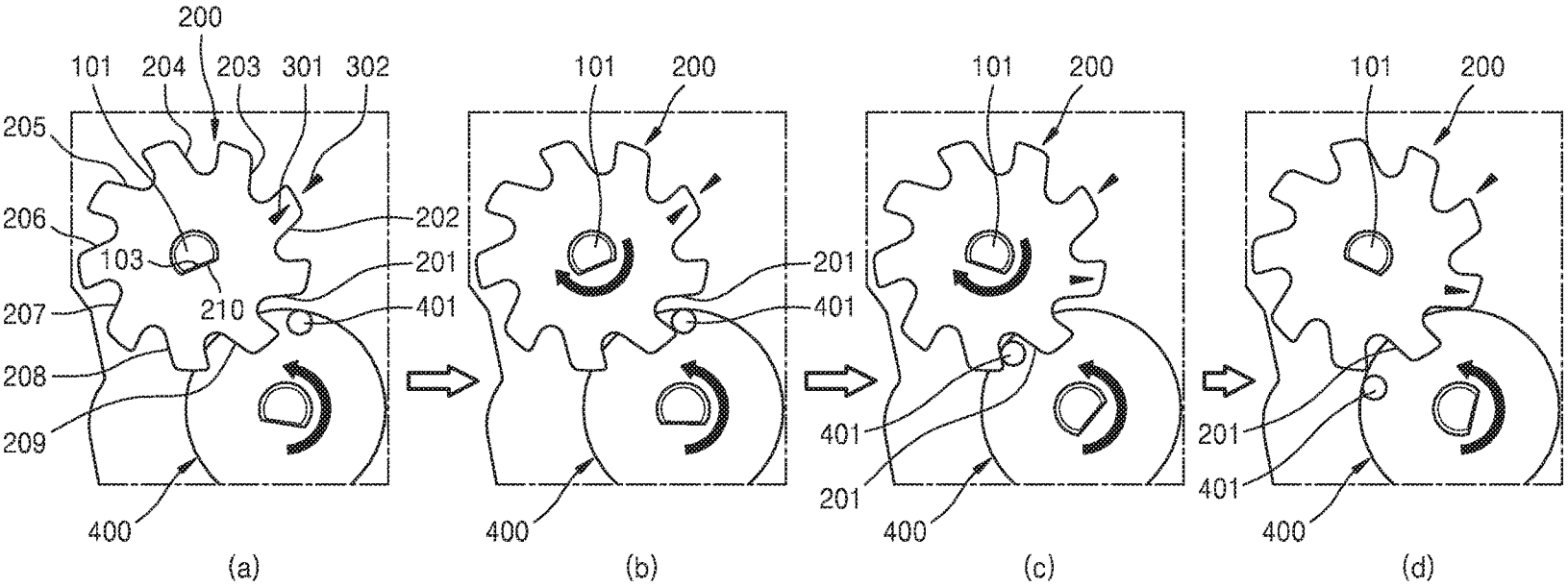
FIG. 9 is a side view of the first and second power transmission members according to an embodiment.

FIG. 9 is a side view of the first and second power transmission members 200 and 400 according to an embodiment. Referring to FIG. 9, the first power transmission member 200 includes nine slots 201, 202, 203, 204, 205, 206, 207, 208, and 209. The second power transmission member 400 includes a pin 401. The nine slots 201 to 209 are provided to form 40° therebetween. According to the above-described configuration, the stirring member 100 may intermittently rotate at a reduction ratio of 9:1. The reference location provider may be implemented as the first indicator 301 provided on the first power transmission member 200, and the second indicator 302 provided on the side wall 111 of the housing 110.

Figure 10:
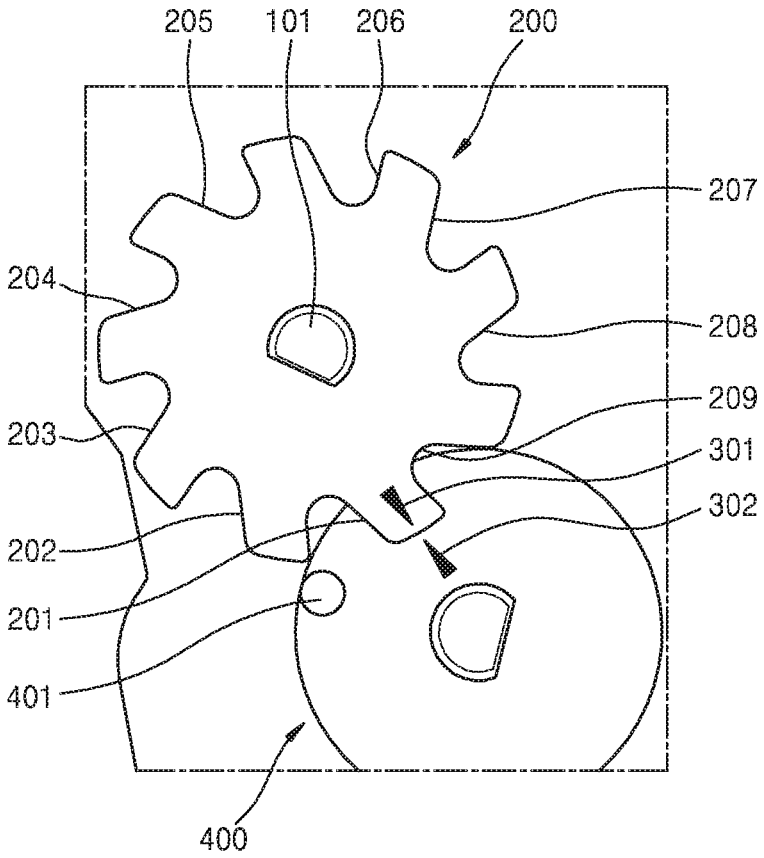
FIG. 10 is a schematic diagram of a reference location provider according to an embodiment.

The reference location provider may be alternatively provided on the first and second power transmission members 200 and 400. FIG. 10 is a schematic diagram of the reference location provider according to an embodiment. In the embodiment of FIG. 9, the stirring member 100 has nine stop locations and at least one thereof may be a location where the stirring film 102 does not contact the internal wall 21*a* of the toner container 21. For example, if the stirring film 102 does not contact the internal wall 21*a* of the toner container 21 at a stop location after the contact between the slot 201 and the pin 401 has terminated, i.e., the state of FIG. 9 part (d), as illustrated in FIG. 10, the first indicator 301 may be generated between the slots 201 and 202 of the first power transmission member 200, and the second indicator 302 may be generated at an upstream side of the pin 401 based on a rotation direction of the second power transmission member 400.

Figure 11:
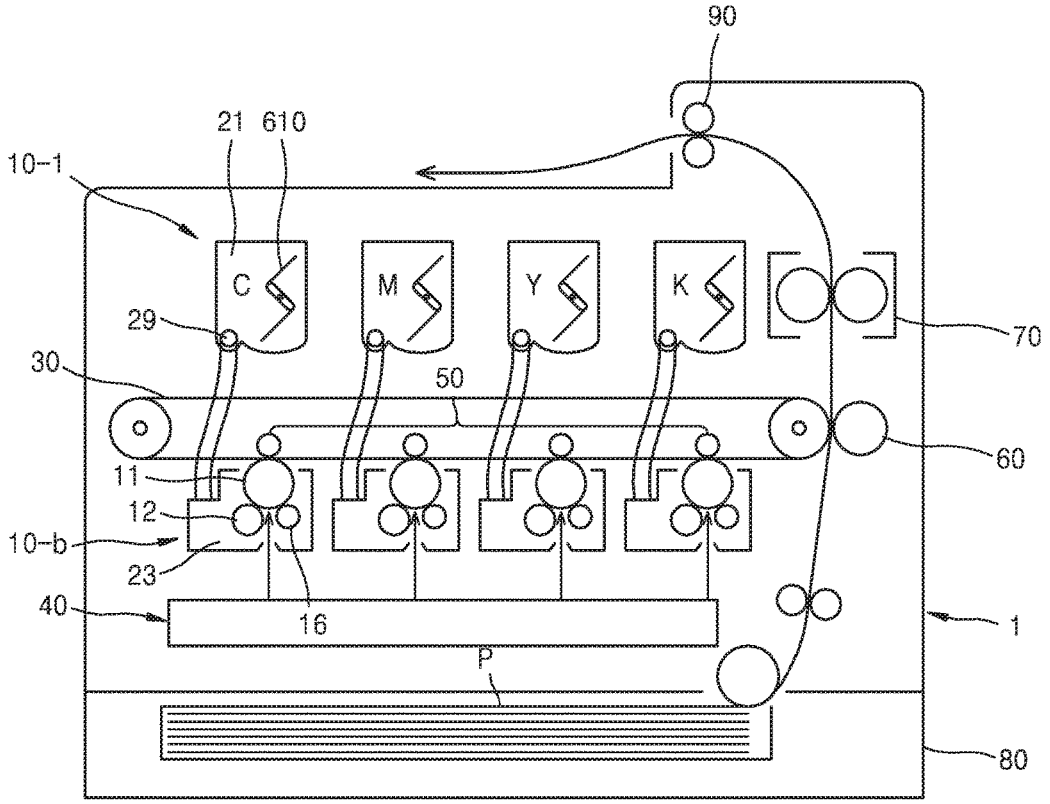
FIG. 11 is a structural view of an electrophotographic image forming apparatus according to an embodiment.

FIG. 11 is a structural view of an electrophotographic image forming apparatus according to an embodiment. The image forming apparatus according to the current embodiment prints color images using electrophotography.

Referring to FIG. 11, the image forming apparatus includes a plurality of imaging cartridges 10-*b* and a plurality of toner cartridges 10-1 containing toners. The toner cartridges 10-1 are respectively connected to the imaging cartridges 10-*b*, and toners contained in the toner cartridges 10-1 are respectively supplied to the imaging cartridges 10-*b*. The toner cartridges 10-1 and the imaging cartridges 10-*b* may be individually replaced.

The imaging cartridges 10-*b* include a plurality of imaging cartridges 10-bC, 10-bM, 10-bY, and 10-bK for developing cyan (C), magenta (M), yellow (Y), and black (K) images. The toner cartridges 10-1 may include a plurality of toner containers 21C, 21M, 21Y, and 21K containing C, M, Y, and K toners to be supplied to the imaging cartridges 10-bC, 10-bM, 10-bY, and 10-bK, respectively. However, the scope of the present disclosure is not limited thereto, and the image forming apparatus may further include a plurality of toner cartridges 10-1 and a plurality of imaging cartridges 10-*b* for containing and developing toners of various colors other than the above-mentioned colors, e.g., light magenta and white. In the following description, it is assumed that the image forming apparatus includes the imaging cartridges 10-bC, 10-bM, 10-bY, and 10-bK and the toner cartridges 10-1C, 10-1M, 10-1Y, and 10-1K, and C, M, Y, and K following reference numerals denote elements for developing cyan, magenta, yellow, and black toners, respectively, unless the context clearly indicates otherwise.

Each of the imaging cartridges 10-*b* may include a photosensitive drum 11 for forming an electrostatic latent image on a surface thereof, and a developing roller 12 for developing the electrostatic latent image into a visible toner image by supplying the toner from each of the toner cartridges 10-1 to the electrostatic latent image. The photosensitive drum 11 is an example of a photoconductor for forming an electrostatic latent image on a surface thereof, and may include a conductive metal pipe, and a photosensitive layer provided on an outer circumferential surface of the conductive metal pipe. A charging roller 16 is an example of a charger for charging the photosensitive drum 11 to have a uniform surface potential. A charging brush, a corona charger, or the like may be used instead of the charging roller 16.

Although not shown in FIG. 11, the imaging cartridge 10-*b* may further include a charging roller cleaner for removing a foreign substance adhered to the charging roller 16, e.g., the toner or dust, a cleaning member for removing the toner remaining on the surface of the photosensitive drum 11 after an intermediate transfer operation to be described below, a supply roller for supplying the toner in a developing section 23 of the imaging cartridge 10-*b*, to the developing roller 12, a regulation member for regulating the amount of the toner supplied to a developing area where the photosensitive drum 11 and the developing roller 12 face each other, a cleaning means for removing a waste toner remaining on the photosensitive drum 11 after a transfer operation to be described below, a waste toner container for containing the waste toner, etc.

A configuration for developing of the image forming apparatus according to an embodiment has been described above in detail. However, the configuration for developing is not limited thereto and may be variously changed or modified based on a developing scheme.

An exposer 40 is an element for forming electrostatic latent images on the photosensitive drums 11 by irradiating light modified to correspond to image information, onto the photosensitive drums 11. A representative example thereof is a laser scanning unit (LSU) using a laser diode as a light source, or a light emitting diode (LED) exposer using an LED as a light source.

An intermediate transfer belt 30 temporarily contains toner images developed on the photosensitive drums 11 of the imaging cartridges 10-bC, 10-bM, 10-bY, and 10-bK. A plurality of intermediate transfer rollers 50 are provided to face the photosensitive drums 11 of the imaging cartridges 10-bC, 10-bM, 10-bY, and 10-bK with respect to the intermediate transfer belt 30 intervened therebetween. An intermediate transfer bias voltage for intermediately transferring the images developed on the photosensitive drums 11, onto the intermediate transfer belt 30 is applied to the intermediate transfer rollers 50. Corona transferers or pin-scorotron transferers may be used instead of the intermediate transfer rollers 50.

A transfer roller 60 is located to face the intermediate transfer belt 30. A transfer bias voltage for transferring the toner images transferred onto the intermediate transfer belt 30, onto a recording medium P is applied to the transfer roller 60.

Although the images developed on the photosensitive drums 11 are intermediately transferred onto the intermediate transfer belt 30 and then are transferred onto the recording medium P passing between the intermediate transfer belt 30 and the transfer roller 60 in the above description according to an embodiment, the present disclosure is not limited thereto. The recording medium P may directly pass between the intermediate transfer belt 30 and the photosensitive drums 11 and thus the developed images may be directly transferred onto the recording medium P. In this case, the transfer roller 60 is not used.

A fuser 70 applies heat and/or pressure to the toner images transferred onto the recording medium P, and thus fixes the toner images on the recording medium P. The fuser 70 is not limited to the type illustrated in FIG. 11.

According to the above-described configuration, the exposer 40 forms electrostatic latent images on the photosensitive drums 11 of the imaging cartridges 10-bC, 10-bM, 10-bY, and 10-bK by irradiating light modified to correspond to image information of a plurality of colors, onto the photosensitive drums 11. The electrostatic latent images of the photosensitive drums 11 of the imaging cartridges 10-bC, 10-bM, 10-bY, and 10-bK are developed into visible toner images due to the C, M, Y, and K toners supplied from the toner cartridges 10-1C, 10-1M, 10-1Y, and 10-1K to the imaging cartridges 10-bC, 10-bM, 10-bY, and 10-bK. The developed toner images are sequentially and intermediately transferred onto the intermediate transfer belt 30. The recording medium P accommodated in a paper tray 80 is fed between the transfer roller 60 and the intermediate transfer belt 30. The toner images intermediately transferred onto the intermediate transfer belt 30 are transferred onto the recording medium P due to a transfer bias voltage applied to the transfer roller 60. After the recording medium P passes through the fuser 70, the toner images are fixed on the recording medium P due to heat and pressure. The recording medium P, on which the toner images are completely fixed, is discharged by discharge rollers 90.

Figure 12:
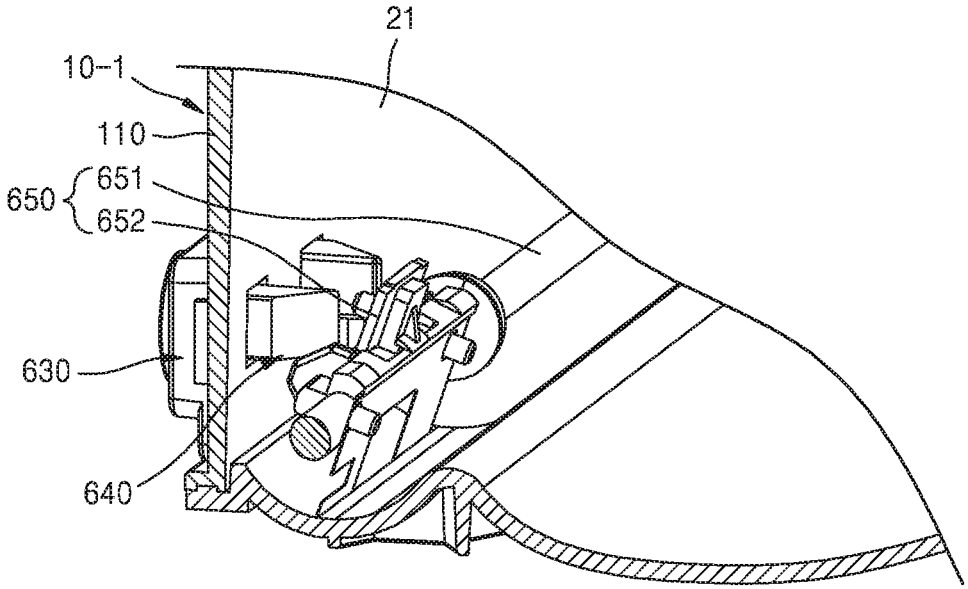
FIG. 12 is a cross-sectional view of a toner cartridge according to an embodiment.
Figure 13:
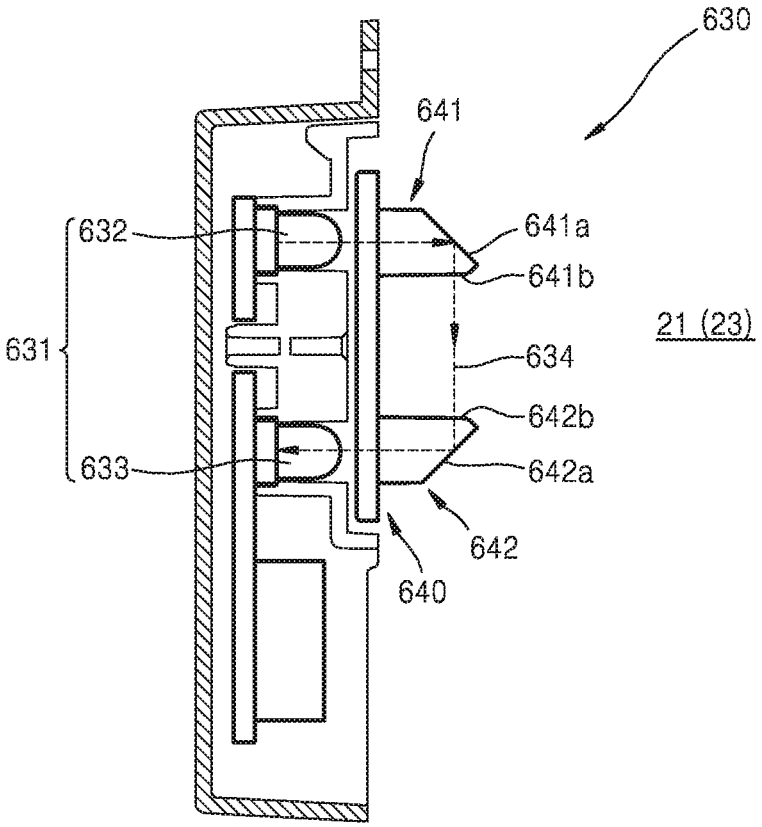
FIG. 13 is a structural view of a toner amount detector according to an embodiment.

The toner cartridge 10-1 includes a toner amount detector for detecting the amount of the toner. FIG. 12 is a cross-sectional view of the toner cartridge 10-1 according to an embodiment. FIG. 13 is a structural view of a toner amount detector 630 according to an embodiment.

Referring to FIGS. 11 and 12, a toner container 21 is provided in a housing 110. The toner container 21 includes a stirring member 610 for stirring the toner. The toner container 21 may further include a carrying member (not shown) for carrying the toner in the toner container 21 toward a toner discharge port 29. The toner is discharged from the toner cartridge 10-1 through the toner discharge port 29, and is carried to the imaging cartridge 10-*b*. The toner cartridge 10-1 includes the toner amount detector 630 for detecting the amount of the toner in the toner container 21.

Referring to FIGS. 12 and 13, the toner amount detector 630 includes an optical sensor 631. The optical sensor 631 includes a light emitter 632 and a light receiver 633. Light 634 emitted from the light emitter 632 passes through the toner container 21 and is incident on the light receiver 633. The light emitter 632 and the light receiver 633 are provided outside the toner container 21 not to be contaminated with the toner. A light guide member 640 guides the light 634 emitted from the light emitter 632, to the light receiver 633 through the toner container 21. The light guide member 640 may include first and second light guides 641 and 642. The first and second light guides 641 and 642 are located in the toner container 21 to be spaced apart from each other. The first light guide 641 guides the light 634 emitted from the light emitter 632, to the toner container 21. The second light guide 642 guides the light 634 passed through the toner container 21, to the light receiver 633. The first and second light guides 641 and 642 include first and second optical path changers 641*a* and 642*a*, respectively. The first optical path changer 641*a* reflects the light 634 emitted from the light emitter 632, toward the second optical path changer 642*a*, and the second optical path changer 642*a* reflects the light 634 incident thereon, toward the light receiver 633. The first and second light guides 641 and 642 may be made of a light-transmitting material capable of transmitting the light 634 therethrough. The first and second optical path changers 641*a* and 642*a* may be implemented as, for example, slopes having predetermined angles of inclination. The angles of inclination of the slopes may be, for example, angles satisfying a total reflection condition.

According to the above-described configuration, because the amount of light detected by the light receiver 633 varies depending on the level of the toner of the toner container 21, the amount of the toner in the toner container 21 may be detected based on the amount of light received by the light receiver 633. If the amount of the toner detected by the toner amount detector 630 is less than a predetermined amount, this may indicate that the toner in the toner container 21 is almost exhausted. Because the optical sensor 631 is located outside the toner container 21 and thus does not directly contact the toner in the toner container 21, the optical sensor 631 is not contaminated with the toner.

A light exit surface 641*b* and a light incident surface 642*b* of the first and second light guides 641 and 642, which face each other, contact the toner in the toner container 21. If the light exit surface 641*b* and the light incident surface 642*b* are contaminated with the toner, the amount of the toner may not be reliably detected. FIG. 12 illustrates a cleaning member 650 including a rotation shaft 651 and a wiper 652 provided on the rotation shaft 651 to wipe the light exit surface 641*b* and the light incident surface 642*b*. When the rotation shaft 651 rotates, the wiper 652 cyclically wipes the light exit surface 641*b* and the light incident surface 642*b* to remove the toner adhered to the light exit surface 641*b* and the light incident surface 642*b*. According to the above-described configuration, the reliability of detection of the amount of the toner may be improved.

The wiper 652 may be, for example, a blade or a brush made of a flexible and elastic material such as urethane. The rotation shaft 651 having the wiper 652 provided thereon rotates by receiving power from the body 1 when the toner cartridge 10-1 is mounted in the body 1. Therefore, the wiper 652 continuously wipes the light exit surface 421*b* and the light incident surface 422*b* during a printing operation.

Because the amount of the toner may be intermittently detected, the light exit surface 421*b* and the light incident surface 422*b* do not need to be continuously wiped. If the wiper 652 continuously performs the wiping operation, because the wiper 652 is worn within a short time, wiping performance may deteriorate and thus an error may occur in detecting the amount of the toner. Considering this, a structure for intermittently rotating the rotation shaft 651 having the wiper 652 provided thereon may be used.

For example, as the structure for intermittently rotating the rotation shaft 651 having the wiper 652 provided thereon, the first and second power transmission members 200 and 400 illustrated in FIG. 3 may be used. In this case, the rotation shaft 101 of FIG. 3 is replaced with the rotation shaft 651. The process cartridge 10 is replaced with the toner cartridge 10-1. The housing 110 of the process cartridge 10 is replaced with the housing 110 of the toner cartridge 10-1. The first power transmission member 200 is coupled to the rotation shaft 651. The second power transmission member 400 is supported by, for example, the housing 110 of the toner cartridge 10-1, and is connected to the motor 920 (see FIG. 8) of the body 1 to intermittently transmit a driving force of the motor 920 to the first power transmission member 200.

According to the above-described configuration, because the wiper 652 may be configured to intermittently wipe the light exit surface 421*b* and the light incident surface 422*b*, wiping performance of the wiper 652 may be stably maintained for a life time of the toner cartridge 10-1, and the reliability of detection of the amount of the toner may be ensured.

The toner cartridge 10-1 may be packaged together with or separately from the body 1 before being sold. When the toner cartridge 10-1 is produced, if the toner cartridge 10-1 is assembled in a state that the wiper 652 contacts the light exit surface 421*b* and the light incident surface 422*b*, the wiper 652 is maintained in the state contacting the light exit surface 421*b* and the light incident surface 422*b* before a user purchases and inserts the toner cartridge 10-1 into the body 1 and starts a printing operation. As such, the wiper 652 may deform.

When the toner cartridge 10-1 is produced, the wiper 652 (more particularly, the rotation shaft 651) is assembled to the housing 110 in such a manner that the wiper 652 does not contact the light exit surface 421*b* and the light incident surface 422*b*. To this end, the toner cartridge 10-1 includes a reference location provider for providing a reference location in such a manner that the wiper 652 is located not to contact the light exit surface 421*b* and the light incident surface 422*b*. The reference location provider illustrated in FIG. 3 may be applied to the toner cartridge 10-1. In this case, the rotation shaft 101 of FIG. 3 is replaced with the rotation shaft 651. The process cartridge 10 is replaced with the toner cartridge 10-1. The housing 110 of the process cartridge 10 is replaced with the housing 110 of the toner cartridge 10-1.

The reference location provider may be implemented as a first indicator 301 provided on the first power transmission member 200 coupled to the rotation shaft 651, and a second indicator 302 provided on a side wall 111 of the housing 110 of the toner cartridge 10-1. The first power transmission member 200 and the rotation shaft 651 are always coupled to each other at the same coupling location. That is, a first coupling indicator 103 is provided on the rotation shaft 651, and a second coupling indicator 210 is provided on the first power transmission member 200. If the first power transmission member 200 and the rotation shaft 651 are coupled to each other by aligning the first and second coupling indicators 103 and 210, a relative location between the first indicator 301 and the wiper 652 is correspondingly determined. Accordingly, when the toner cartridge 10-1 is produced, the wiper 652 may be provided at a location not contacting the light exit surface 421*b* and the light incident surface 422*b*, by aligning the first and second indicators 301 and 302 with each other after the rotation shaft 651 is assembled to the housing 110.

When the embodiments of the intermittent rotation structure illustrated in FIGS. 3 to 6 are applied to the intermittent rotation structure of the wiper 652, the wiper 652 may have four stop locations and at least one thereof may be a location where the wiper 652 does not contact the light exit surface 421*b* and the light incident surface 422*b*. Therefore, the reference location provider may be implemented as the first and second indicators 301 and 302 provided on the first and second power transmission members 200 and 400, respectively, as illustrated in FIG. 7.

The technical features described above in relation to FIG. 8 may be applied to stop the rotation shaft 651 at a location where the wiper 652 does not contact the light exit surface 421*b* and the light incident surface 422*b* when the printing operation has terminated. In this case, the process cartridge 10 of FIG. 8 is replaced with the toner cartridge 10-1, and the stirring member 100 is replaced with the rotation shaft 651.

For example, the controller 910 may control the motor 920 to stop the rotation shaft 651 at a reference location, i.e., a location where the wiper 652 does not contact the light exit surface 421*b* and the light incident surface 422*b*. For example, the controller 910 may stop the motor 920 after driving the motor 920 by an integer multiple of the unit driving time t1 of the motor 920 taken to rotate the rotation shaft 651 by one full turn. Because the rotation shaft 651 always stops at the reference location due to the reference location provider, if the motor 920 is controlled as described above, the rotation shaft 651 may always stop rotating at the reference location.

As described above, the rotation location detector 500 for detecting a rotation location of the rotation shaft 651 may be further provided, and the controller 910 may stop the rotation shaft 651 at a location where the wiper 652 does not contact the light exit surface 421*b* and the light incident surface 422*b*, by receiving a detection signal of the rotation location detector 500 and stopping the motor 920 at a timing when the reference location is detected.

A reduction ratio of the first and second power transmission members 200 and 400 for driving the wiper 652 is not limited to the above-described examples.

Figure 14:
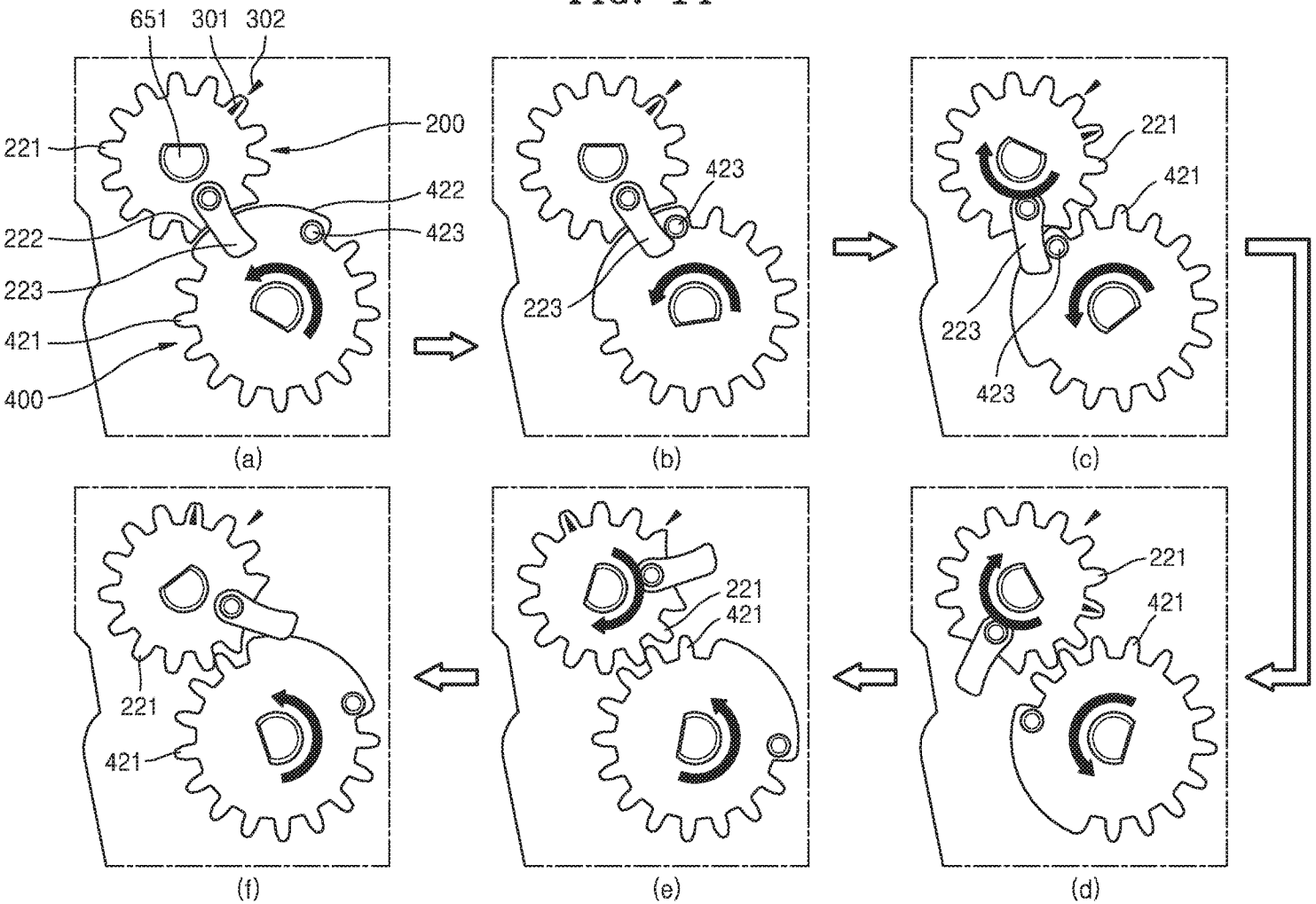
FIG. 14 is a structural view of the first and second power transmission members according to an embodiment.

FIG. 14 is a structural view of the first and second power transmission members 200 and 400 according to an embodiment. Referring to FIG. 14, the first power transmission member 200 includes a first gear part 221, a first non-gear part 222, and a lever 223 located at the first non-gear part 222. The second power transmission member 400 includes a second gear part 421 engaged with the first gear part 221, a second non-gear part 422 corresponding to the first non-gear part 222, and a pin 423 located at a downstream side of the second non-gear part 422 based on a rotation direction of the second power transmission member 400.

The first and second non-gear parts 222 and 422 are parts where no gears are provided, and have shapes complementary to each other in such a manner that the second power transmission member 400 rotates without being engaged with the first power transmission member 200. Therefore, in a rotation period when the first and second non-gear parts 222 and 422 face each other as illustrated in FIG. 14 part (a), even though the second power transmission member 400 rotates, the first power transmission member 200 does not rotate. If the second power transmission member 400 continuously rotates and thus the pin 423 contacts the lever 223 as illustrated in FIG. 14 part (b), the pin 423 pushes the lever 223 and thus the first power transmission member 200 also rotates. In the state illustrated in FIG. 14 part (c), the first and second gear parts 221 and 421 are engaged with each other. Accordingly, in a period when the first and second gear parts 221 and 421 are engaged with each other as illustrated in FIGS. 14 part (d) and 14 part (e), the second and first power transmission members 400 and 200 rotate together. If the engaging between the first and second gear parts 221 and 421 has terminated, as illustrated in FIG. 14 part (f), the first and second non-gear parts 222 and 422 face each other and thus the first power transmission member 200 stops rotating. By repeating the above-described procedure, the stirring member 100 may intermittently rotate.

Figure 15:
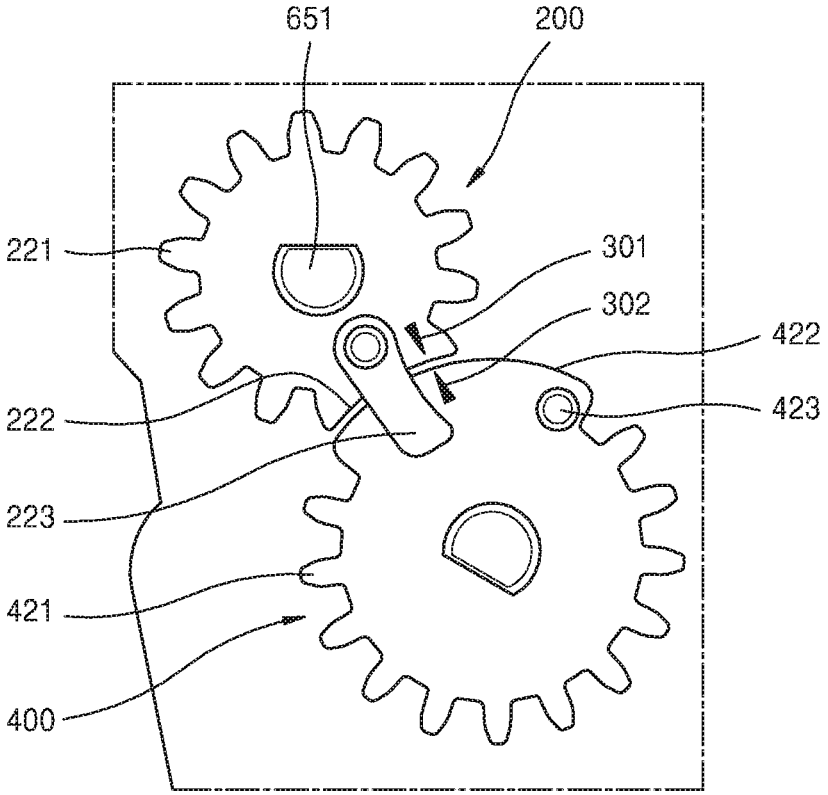
FIG. 15 is a diagram showing a reference location provider according to an embodiment.

The reference location provider may be implemented as the first indicator 301 provided on the first power transmission member 200, and the second indicator 302 provided on the side wall 111 of the housing 110, as illustrated in FIG. 14 part (a). In the embodiment of FIG. 14, because the number of teeth of the first gear part 221 is the same as the number of teeth of the second gear part 421, a reduction ratio of the first and second power transmission members 200 and 400 is 1:1. When the first and second non-gear parts 222 and 422 face each other, even though the second power transmission member 400 rotates, the first power transmission member 200 does not rotate. For example, when the wiper 652 does not contact the light exit surface 421*b* and the light incident surface 422*b* at a stop location where the first and second non-gear parts 222 and 422 face each other, i.e., when the stop location is a reference location, the first and second indicators 301 and 302 may be provided on the first and second non-gear parts 222 and 422, respectively, as illustrated in FIG. 15.

Figure 16:
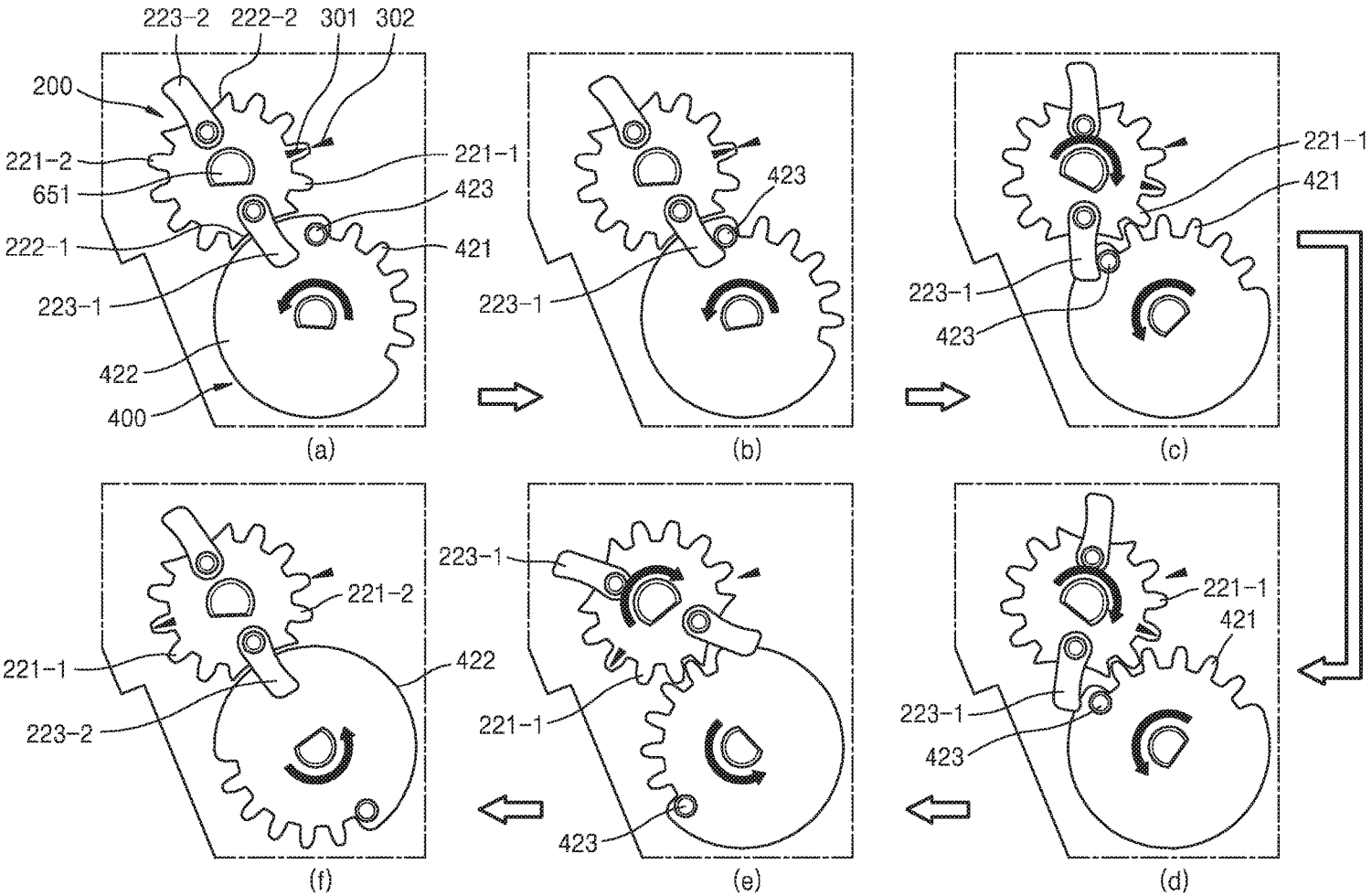
FIG. 16 is a structural view of the first and second power transmission members according to an embodiment.

FIG. 16 is a structural view of the first and second power transmission members 200 and 400 according to an embodiment. The embodiment of FIG. 16 is modified from the embodiment of FIG. 14, and the first and second power transmission members 200 and 400 have a reduction ratio of 2:1 herein.

Referring to FIG. 16, the first power transmission member 200 includes a pair of first gear parts 221-1 and 221-2, a pair of first non-gear parts 222-1 and 222-2, and a pair of levers 223-1 and 223-2 located at the first non-gear parts 222-1 and 222-2, respectively. The second power transmission member 400 includes a second gear part 421 engaged sequentially with the first gear parts 221-1 and 221-2, a second non-gear part 422 corresponding sequentially to the first non-gear parts 222-1 and 222-2, and a pin 423 located at an upstream side of the second non-gear part 422 based on a rotation direction of the second power transmission member 400.

The first non-gear parts 222-1 and 222-2, and the second non-gear part 422 are parts where no gears are provided, and have shapes complementary to each other in such a manner that the second power transmission member 400 rotates without being engaged with the first power transmission member 200. Therefore, in a rotation period when the first non-gear part 222-1 and the second non-gear part 422 face each other as illustrated in FIG. 16 part (a), even though the second power transmission member 400 rotates, the first power transmission member 200 does not rotate. If the second power transmission member 400 continuously rotates and thus the pin 423 contacts the lever 223-1 as illustrated in FIG. 16 part (b), the pin 423 pushes the lever 223-1 and thus the first power transmission member 200 also rotates. In the state illustrated in FIG. 16 part (c), the first gear part 221-1 and the second gear part 421 are engaged with each other. Accordingly, in a period when the first gear part 221-1 and the second gear part 421 are engaged with each other as illustrated in FIG. 16 part (d) and part (e), the second and first power transmission members 400 and 200 rotate together. If the engaging between the first gear part 221-1 and the second gear part 421 has terminated, as illustrated in FIG. 16 part (f), the first non-gear part 222-2 and the second non-gear part 422 face each other and thus the first power transmission member 200 stops rotating. Subsequently, although not shown in FIG. 16, the pin 423 contacts the lever 223-2, the first gear part 221-2 is engaged with the second gear part 421, and the first non-gear part 222-1 and the second non-gear part 422 face each other. According to the above-described configuration, because the first gear part 221-1, the first gear part 221-2, and the second gear part 421 have the same number of teeth, the stirring member 100 may intermittently rotate at a reduction ratio of 2:1.

Figure 17:
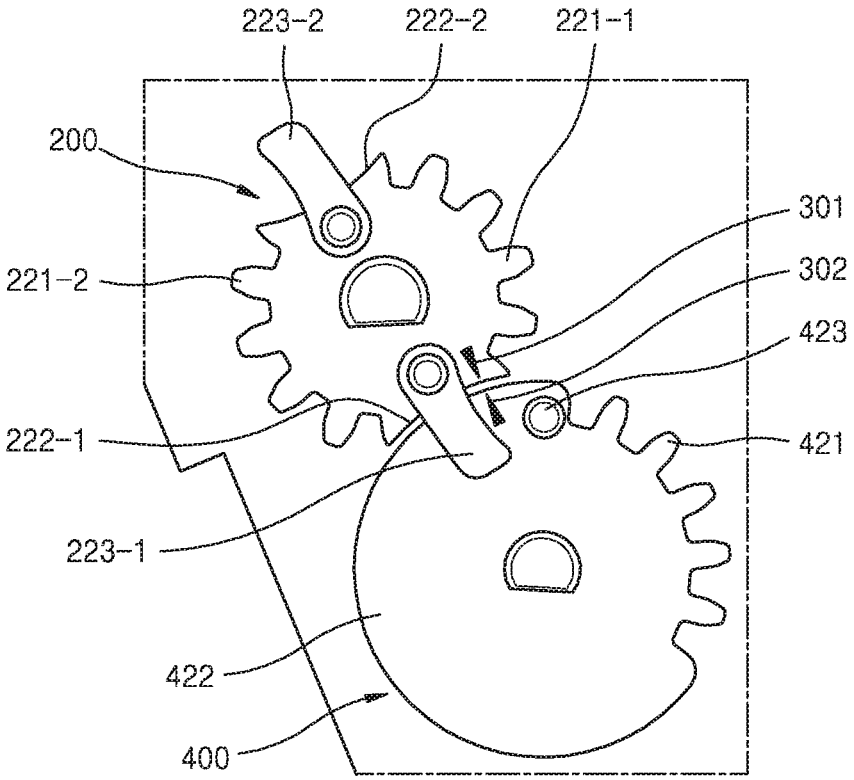
FIG. 17 is a diagram showing the reference location provider according to an embodiment.

The reference location provider may be implemented as the first indicator 301 provided on the first power transmission member 200, and the second indicator 302 provided on the side wall 111 of the housing 110, as illustrated in FIG. 16 part (a). In the embodiment of FIG. 16, the rotation shaft 651 may have two stop locations (e.g., a location where the first non-gear part 222-1 and the second non-gear part 422 face each other and a location where the first non-gear part 222-2 and the second non-gear part 422 face each other) and at least one of the two stop locations may be a location where the wiper 652 does not contact the light exit surface 421*b* and the light incident surface 422*b*. For example, if the wiper 652 does not contact the light exit surface 421*b* and the light incident surface 422*b* at the location where the first non-gear part 222-1 and the second non-gear part 422 face each other, the first and second indicators 301 and 302 may be provided on the first non-gear part 222-1 and the second non-gear part 422, respectively, as illustrated in FIG. 17.

Figure 18:
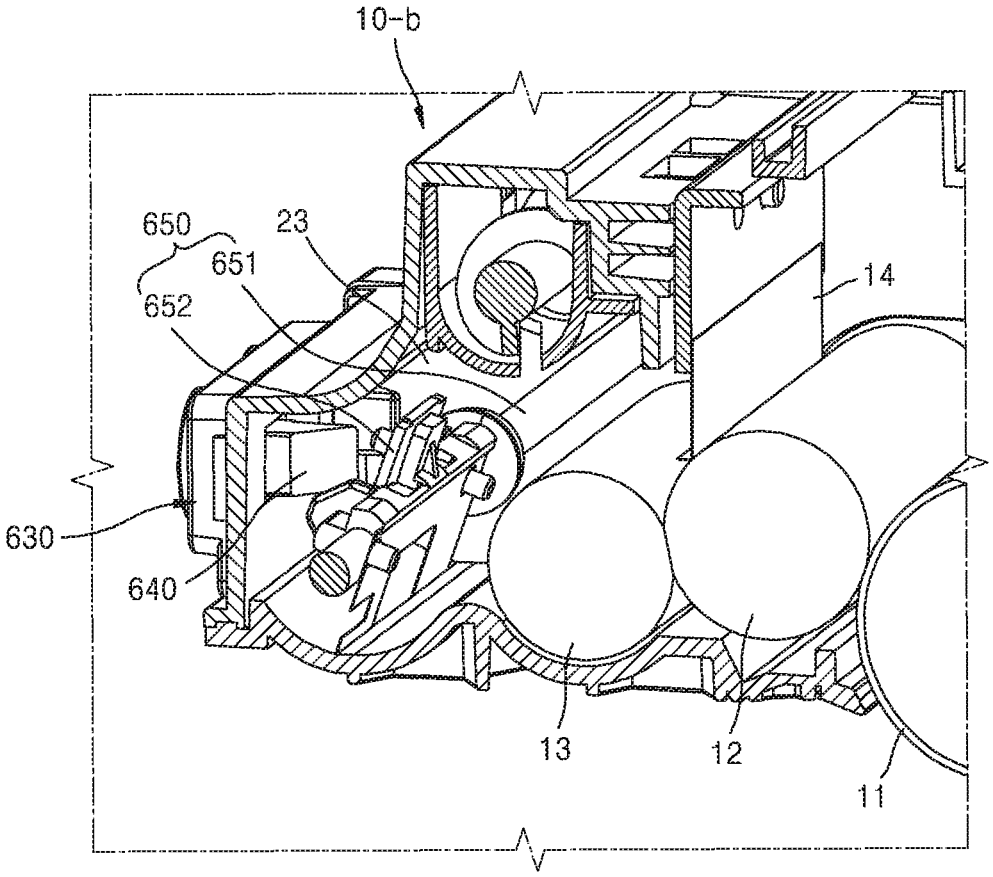
FIG. 18 is a cross-sectional view of an imaging cartridge according to an embodiment.

The developing section 23 serves as a toner container containing the toner supplied from the toner cartridge 10-1. Therefore, the toner amount detector 630 may be alternatively included in the imaging cartridge 10-*b* to detect the amount of the toner in the developing section 23. FIG. 18 is a cross-sectional view of the imaging cartridge 10-*b* according to an embodiment.

Referring to FIG. 18, the toner is discharged from the toner cartridge 10-1 through the toner discharge port 29, and is carried to the developing section 23 of the imaging cartridge 10-*b*. The imaging cartridge 10-*b* includes the toner amount detector 630 for detecting the amount of the toner in the developing section 23.

The basic structure of the toner amount detector 630 is the same as that illustrated in FIG. 13. Accordingly, in the case, the toner container 21 of FIG. 13 is replaced with the developing section 23. The light emitter 632 and the light receiver 633 are located outside the developing section 23, and the light 634 emitted from the light emitter 632 is guided by the light guide member 640 to pass through the developing section 23 and to be incident on the light receiver 633. The light guide member 640 includes the first optical path changer 641*a*, the light exit surface 641*b*, the light incident surface 642*b*, and the second optical path changer 642*a*. The light 634 emitted from the light emitter 632 passes sequentially through the first optical path changer 641*a*, the light exit surface 641*b*, the light incident surface 642*b*, and the second optical path changer 642*a* and is guided to the light receiver 633.

According to the above-described configuration, because the amount of light detected by the light receiver 633 varies depending on the amount of the toner of the developing section 23, the amount of the toner in the developing section 23 may be detected based on the amount of light received by the light receiver 633.

Referring to FIG. 18, the wiper 652 for wiping the light exit surface 641*b* and the light incident surface 642*b* is provided in the developing section 23. The wiper 652 cyclically wipes the light exit surface 641*b* and the light incident surface 642*b* to remove the toner adhered to the light exit surface 641*b* and the light incident surface 642*b*. For example, the wiper 652 may be provided on the rotation shaft 651 of the developing section 23 and rotate to wipe the light exit surface 421*b* and the light incident surface 422*b*. The wiper 652 may be, for example, a blade or a brush made of a flexible and elastic material such as urethane. The rotation shaft 651 rotates by receiving power from the body 1 when the imaging cartridge 10-*b* is mounted in the body 1. Therefore, the wiper 652 continuously wipes the light exit surface 421*b* and the light incident surface 422*b* during a printing operation.

The embodiments of FIGS. 3 to 10 and 14 to 17 related to the first and second power transmission members 200 and 400 and the reference location provider may be applied to intermittently rotate the rotation shaft 651 having the wiper 652 provided thereon, and to provide the wiper 652 at a location not contacting the light exit surface 421*b* and the light incident surface 422*b*. In this case, the rotation shaft 101 of FIGS. 3 to 7 is replaced with the rotation shaft 651. The process cartridge 10 of FIGS. 3 to 10 or the toner cartridge 10-1 of FIGS. 14 to 17 is replaced with the imaging cartridge 10-*b*. The first power transmission member 200 is coupled to the rotation shaft 651. The second power transmission member 400 is connected to the motor 920 (see FIG. 8) of the body 1 to intermittently transmit a driving force of the motor 920 to the first power transmission member 200.

According to the above-described configuration, because the wiper 652 may be configured to intermittently wipe the light exit surface 421*b* and the light incident surface 422*b*, wiping performance of the wiper 652 may be stably maintained for a life time of the imaging cartridge 10-*b*, and the reliability of detection of the amount of the toner may be ensured. In addition, due to the first and second indicators 301 and 302, when the imaging cartridge 10-*b* is produced, the wiper 652 may be provided at a location not contacting the light exit surface 421*b* and the light incident surface 422*b*.

The procedure for controlling the motor 920 to stop the wiper 652 at a location not contacting the light exit surface 421*b* and the light incident surface 422*b* after the printing operation, which is described above in relation to FIG. 8, may be applied to control rotation of the rotation shaft 651 having the wiper 652 provided thereon, in FIG. 18.

According to the above-described embodiments of cartridges and an electrophotographic image forming apparatus, stable image quality may be achieved.

According to the above-described embodiments of cartridges and an electrophotographic image forming apparatus, a toner may be stably stirred and supplied to a developing section.

According to the above-described embodiments of cartridges and an electrophotographic image forming apparatus, deterioration of properties of a toner contained in the toner container may be prevented.

According to the above-described embodiments of cartridges and an electrophotographic image forming apparatus, the reliability of detection of the amount of a toner may be improved.

While one or more embodiments have been described with reference to the figures, it will be understood by those of ordinary skill in the art that various changes in form and details may be made therein without departing from the spirit and scope as defined by the following claims.

What is claimed is:

1. A cartridge attachable to and detachable from a body of an image forming apparatus, the cartridge comprising:

a toner container containing a toner and comprising a toner container stirring member configured to stir the toner in the toner container;

a developing section connectable to the toner container to receive the toner from the toner container through a supply port and comprising:

a developing section stirring member configured to stir the received toner in the developing section, a supply roller configured to receive the toner supplied from the developing section stirring member, and a developing roller configured to receive the toner supplied from the supply roller;

a first power transmission member coupled to a rotation shaft of the toner container stirring member; and a second power transmission member configured to engage with the first power transmission member to intermittently rotate the toner container stirring member based on a rotation of the supply roller, wherein a rotation ratio of the toner container stirring member to the supply roller is from 5% to 25%.

2. The cartridge of claim 1, wherein a rotation ratio of the developing section stirring member to the supply roller is 50% to 100%.

3. The cartridge of claim 1, wherein the toner container stirring member comprises a stirring film extending from the rotation shaft of the toner container stirring member in a radius direction, and wherein the cartridge further comprises a reference location provider configured to provide a reference location in such a manner that the stirring film is separated from an internal wall of the toner container.

4. The cartridge of claim 3, further comprising a housing configured to support the rotation shaft of the toner container stirring member, wherein the reference location provider comprises a first indicator provided on the first power transmission member, and a second indicator provided on a side wall of the housing, and wherein the stirring film is separated from the internal wall of the toner container by aligning the first indicator with the second indicator.

5. The cartridge of claim 3, wherein the reference location provider comprises a first indicator provided on the first power transmission member, and a second indicator provided on the second power transmission member, and wherein the stirring film is provided separated from the internal wall of the toner container by aligning the first indicator with the second indicator.

6. The cartridge of claim 3, further comprising a rotation location detector configured to detect a rotation location of the stirring film.

7. An electrophotographic image forming apparatus comprising:

a body; and a cartridge attachable to and detachable from a body of an image forming apparatus, the cartridge comprising:

a toner container containing a toner and comprising a toner container stirring member configured to stir the toner in the toner container;

a developing section connectable to the toner container to receive the toner from the toner container through a supply port and comprising:

a developing section stirring member configured to stir the received toner in the developing section, a supply roller configured to receive the toner supplied from the developing section stirring member, and a developing roller configured to receive the toner supplied from the supply roller;

a first power transmission member coupled to a rotation shaft of the toner container stirring member; and a second power transmission member configured to engage with the first power transmission member to intermittently rotate the toner container stirring member based on a rotation of the supply roller, wherein a rotation ratio of the toner container stirring member to the supply roller is from 5% to 25%.

8. The electrophotographic image forming apparatus of claim 7, wherein a rotation ratio of the developing section stirring member to the supply roller is 50% to 100%.

9. The electrophotographic image forming apparatus of claim 7, wherein the toner container stirring member comprises a stirring film extending from the rotation shaft of the toner container stirring member in a radius direction, and wherein the body comprises a motor configured to rotate the toner container stirring member, and a controller configured to control the motor to stop the stirring member at a location where the stirring film is separated from an internal wall of the toner container.

10. The electrophotographic image forming apparatus of claim 9, wherein the toner container stirring member has a plurality of stop locations, wherein at least one of the plurality of stop locations is the location where the toner container stirring film is separated from the internal wall of the toner container, and wherein the controller controls the motor to stop the toner container stirring member at the at least one of the plurality of stop locations corresponding to the location where the stirring film is separated from the internal wall of the toner container.

11. The electrophotographic image forming apparatus of claim 9, further comprising a reference location provider configured to provide a reference location in such a manner that the stirring film is provided at the location where the stirring film is separated from the internal wall of the toner container.

12. The electrophotographic image forming apparatus of claim 11, wherein the controller controls the motor to stop the toner container stirring member at the reference location.

13. The electrophotographic image forming apparatus of claim 12, further comprising a rotation location detector configured to detect the reference location of the toner container stirring member, wherein the controller controls the motor based on a detection signal of the rotation location detector.

14. A cartridge attachable to and detachable from a body of an image forming apparatus, the cartridge comprising:

a toner container containing a toner;

a developing section connectable to the toner container to receive the toner from the toner container;

a light guide member comprising a light exit surface and a light incident surface provided to face each other in at least one of the toner container and the developing section;

an optical sensor comprising a light emitter configured to emit light toward the light exit surface, and a light receiver configured to receive the light incident on the light incident surface;

a cleaning member comprising a rotation shaft and a wiper extending from the rotation shaft in a radius direction to wipe the light exit surface and the light incident surface based on a rotation of the rotation shaft;

a first power transmission member coupled to the rotation shaft; and a second power transmission member configured to engage with the first power transmission member to intermittently rotate the cleaning member.

15. The cartridge of claim 14, further comprising a reference location provider configured to provide a reference location in such a manner that the wiper is provided at a location separated from the light exit surface and the light incident surface.

16. The cartridge of claim 15, further comprising a housing configured to support the rotation shaft, wherein the reference location provider comprises a first indicator provided on the first power transmission member, and a second indicator provided on a side wall of the housing, and wherein the wiper is provided at the location separated from the light exit surface and the light incident surface by aligning the first indicator with the second indicator.

17. The cartridge of claim 15, wherein the reference location provider comprises a first indicator provided on the first power transmission member, and a second indicator provided on the second power transmission member, and wherein the wiper is provided at the location separated from the light exit surface and the light incident surface by aligning the first indicator with the second indicator.

* * * * *